US012790152B2

(12) United States Patent
Niwata

(10) Patent No.: US 12,790,152 B2
(45) Date of Patent: Nov. 10, 2026

(54) MEDIA EJECTING APPARATUS, MEDIA EJECTING METHOD, AND NON-TRANSITORY RECORDING MEDIUM

(71) Applicant: PFU LIMITED, Kahoku (JP)

(72) Inventor: Tomoyuki Niwata, Kahoku (JP)

(73) Assignee: PFU LIMITED, Kahoku (JP)

( * ) Notice: Subject to any disclaimer, the term of this patent is extended or adjusted under 35 U.S.C. 154(b) by 118 days.

(21) Appl. No.: 18/653,509

(22) Filed: May 2, 2024

(65) Prior Publication Data

US 2024/0375898 A1 Nov. 14, 2024

(30) Foreign Application Priority Data

May 12, 2023 (JP) ..... 2023-079536

(51) Int. Cl.
*B65H 9/00* (2006.01)
*B65H 5/06* (2006.01)
*B65H 7/02* (2006.01)

(52) U.S. Cl.
CPC ..... *B65H 7/02* (2013.01); *B65H 5/062* (2013.01); *B65H 2513/10* (2013.01)

(58) Field of Classification Search
CPC ..... B65H 7/02; B65H 5/062; B65H 2513/10; B65H 9/00; B65H 9/002
See application file for complete search history.

(56) References Cited

U.S. PATENT DOCUMENTS

2010/0126827 A1* 5/2010 Fehrenbach ..... B65H 9/002 198/394
2010/0288145 A1* 11/2010 St. Ours ..... B65H 45/28 101/232
2011/0095472 A1* 4/2011 Ishikawa ..... B65H 9/002 271/265.02
2013/0082440 A1* 4/2013 Fujiwara ..... B65H 3/042 271/228
2015/0284205 A1* 10/2015 Gao ..... B65H 7/06 271/265.02
2020/0270084 A1* 8/2020 Wick ..... B65H 7/08
2022/0086294 A1 3/2022 Koyanagi et al.
2022/0212889 A1* 7/2022 Jiang ..... B65H 9/002

FOREIGN PATENT DOCUMENTS

JP 2004-333634 A 11/2004
JP 2007-331908 A 12/2007
JP 2022-49270 A 3/2022

* cited by examiner

*Primary Examiner* — Thomas A Morrison
(74) *Attorney, Agent, or Firm* — WOMBLE BOND DICKINSON US LLP

(57) ABSTRACT

A media ejecting apparatus includes a conveyance roller, an ejection roller, and circuitry. The conveyance roller conveys a first medium and a second medium following the first medium. The ejection roller ejects the first medium and the second medium. The circuitry reduces a first ejection speed at which the ejection roller ejects the first medium. The circuitry determines a first skew of the first medium and a second skew of the second medium, and changes at least one of a reference for determining whether to reduce the first ejection speed, when to reduce the first ejection speed, a conveyance speed at which the conveyance roller conveys the second medium, or a time during which the conveyance roller stops conveying the second medium, based on the first skew or the second skew.

6 Claims, 12 Drawing Sheets

MEDIA EJECTING APPARATUS, MEDIA EJECTING METHOD, AND NON-TRANSITORY RECORDING MEDIUM

CROSS-REFERENCE TO RELATED APPLICATION

This patent application is based on and claims priority pursuant to 35 U.S.C. § 119(a) to Japanese Patent Application No. 2023-079536, filed on May 12, 2023, in the Japan Patent Office, the entire disclosure of which is hereby incorporated by reference herein.

BACKGROUND

Embodiments of the present disclosure relate to a media ejecting apparatus, a media ejecting method, and a non-transitory recording medium.

Media ejecting apparatuses such as scanners that image media while sequentially conveying the media and eject the media onto an ejection table have been required to convey the media at high speeds to reduce the time taken for the conveyance. However, when the media ejecting apparatus ejects media at high speeds, the ejected media are scattered on the ejection table or jump out from the ejection table. As a result, the user may spend a lot of time and effort to align the ejected media.

SUMMARY

According to an embodiment of the present disclosure, a media ejecting apparatus includes a conveyance roller, an ejection roller, and circuitry. The conveyance roller conveys a first medium and a second medium following the first medium. The ejection roller ejects the first medium and the second medium. The circuitry reduces a first ejection speed at which the ejection roller ejects the first medium. The circuitry determines a first skew of the first medium and a second skew of the second medium, and changes at least one of a reference for determining whether to reduce the first ejection speed, when to reduce the first ejection speed, a conveyance speed at which the conveyance roller conveys the second medium, or a time during which the conveyance roller stops conveying the second medium, based on the first skew or the second skew.

According to an embodiment of the present disclosure, a media ejecting method includes conveying, ejecting, and reducing. The conveying is conveying a first medium and a second medium following the first medium with a conveyance roller. The ejecting is ejecting the first medium and the second medium. The reducing is reducing a first ejection speed at which the ejection roller ejects the first medium. The reducing includes determining a first skew of the first medium and a second skew of the second medium, and changing at least one of a reference for determining whether to reduce the first ejection speed, when to reduce the first ejection speed, a conveyance speed at which the conveyance roller conveys the second medium, or a time during which the conveyance roller stops conveying the second medium, based on the first skew or the second skew.

According to an embodiment of the present disclosure, a non-transitory recording medium stores a plurality of instructions which, when executed by one or more processors on a media ejecting apparatus, causes the one or more processors to perform a media ejecting method. The media ejecting apparatus includes a conveyance roller to convey a first medium and a second medium following the first medium, and an ejection roller to eject the first medium and the second medium. The method includes reducing a first ejection speed at which the ejection roller ejects the first medium. The reducing includes determining a first skew of the first medium and a second skew of the second medium, and changing at least one of a reference for determining whether to reduce the first ejection speed at which the ejection roller ejects the first medium, when to reduce the first ejection speed, a conveyance speed at which the conveyance roller conveys the second medium, or a time during which the conveyance roller stops conveying the second medium, based on the first skew or the second skew.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
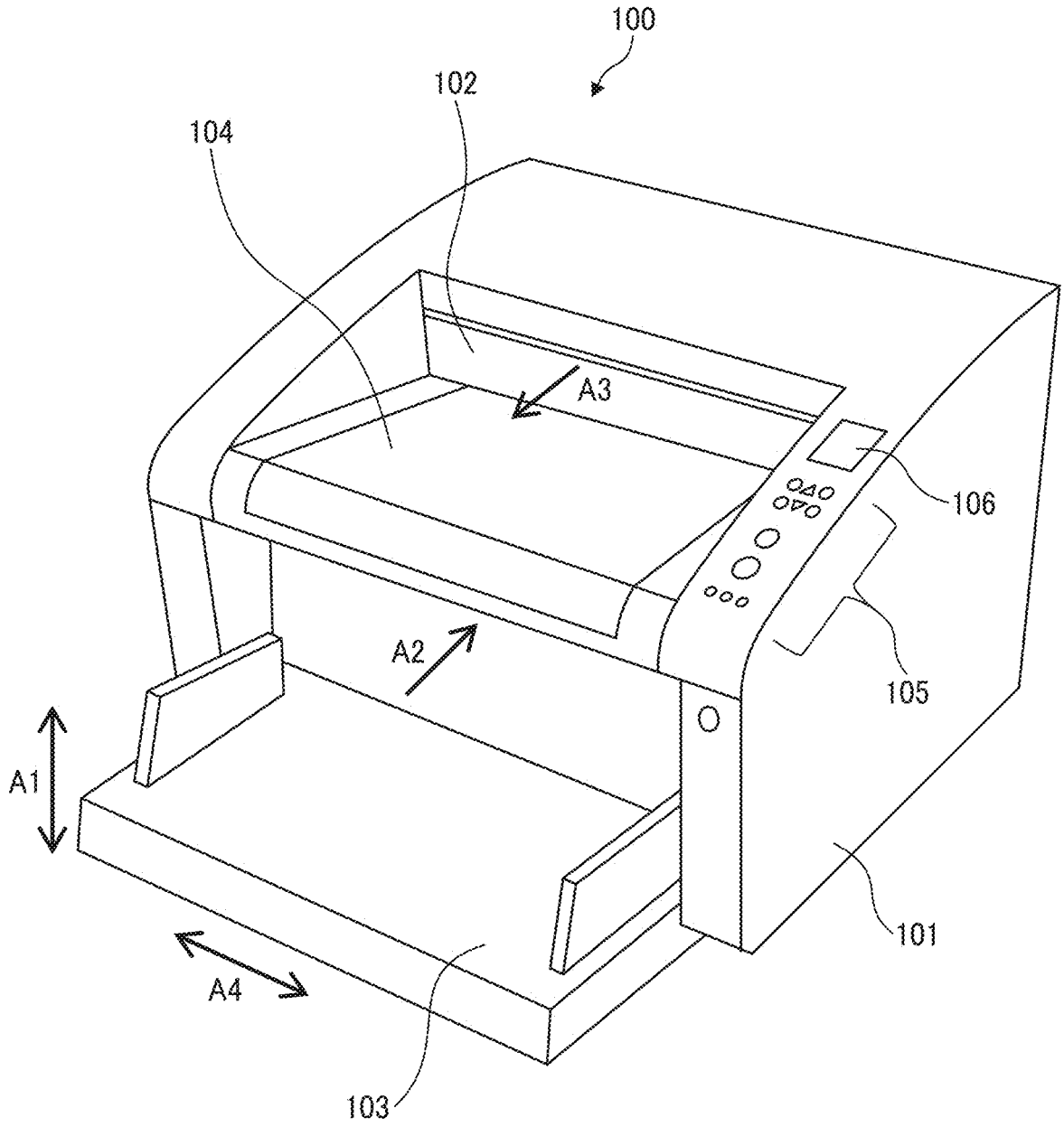
FIG. 1 is a perspective view of a media ejecting apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring to the drawings, embodiments of the present disclosure are described below.

As used herein, the singular forms "a," "an," and "the" are intended to include the plural forms as well, unless the context clearly indicates otherwise.

For the sake of simplicity, like reference signs denote like elements such as parts and materials having the same functions, and redundant descriptions thereof are omitted unless otherwise required.

As used herein, the term "connected/coupled" includes both direct connections and connections in which there are one or more intermediate connecting elements.

FIG. 1 is a perspective view of a media ejecting apparatus 100 as an image scanner. The media ejecting apparatus 100 conveys and images media, which are documents. The media are, for example, sheets of plain paper, sheets of thick paper, or cards. Alternatively, the media ejecting apparatus 100 may be, for example, a facsimile machine, a copier, or a multifunction peripheral (MFP). The media to be conveyed may be, for example, printing material (e.g., paper sheets) instead of documents. In this case, the media ejecting apparatus 100 may be, for example, a printer.

In FIG. 1, arrow A1 indicates a substantially vertical direction (height direction). Arrow A2 indicates a media conveyance direction in which media are conveyed. Arrow A3 indicates a media ejection direction in which media are ejected. Arrow A4 indicates a width direction orthogonal to the media conveyance direction indicated by arrow A2 or the media ejection direction indicated by arrow A3. In the following description, the height direction indicated by arrow A1, the media conveyance direction indicated by arrow A2, the media ejection direction indicated by arrow A3, and the width direction indicated by arrow A4 may be referred to as a height direction A1, a media conveyance direction A2, a media ejection direction A3, and a width direction A4, respectively. In the following description, "upstream" refers to "upstream" in the media conveyance direction A2 or the media ejection direction A3, whereas "downstream" refers to "downstream" in the media conveyance direction A2 or the media ejection direction A3.

The media ejecting apparatus 100 includes, for example, a first housing 101, a second housing 102, a feed table 103, an ejection table 104, an operation device 105, and a display device 106.

The second housing 102 is disposed inside the first housing 101. The second housing 102 is rotatably engaged with the first housing 101 with a hinge such that the second housing 102 can be opened and closed to, for example, remove a jammed medium or clean the inside of the media ejecting apparatus 100.

The feed table 103 is engaged with the first housing 101 such that the media to be conveyed can be placed on the feed table 103. The feed table 103 is movable in the height direction A1 on a medium-supply side of the first housing 101. The medium-supply side of the first housing 101 is the side from which the media are supplied into the first housing 101. When no medium is conveyed, the feed table 103 is positioned at the lower end in the movable range of the feed table 103 to facilitate the placement of media on the feed table 103. When a medium is conveyed, the feed table 103 is raised to a position so that an uppermost medium of the media placed on the feed table 103 comes into contact with a pick roller described later.

The ejection table 104 is formed on the second housing 102. The ejection table 104 receives the medium ejected from a common output port of the first housing 101 and the second housing 102.

The operation device 105 includes an input device such as keys and an interface circuit that acquires signals from the input device. The operation device 105 receives an input operation performed by a user and outputs an operation signal corresponding to the input operation performed by the user. The display device 106 includes a display and an interface circuit that outputs image data to the display, to display the image data on the display. Examples of the display include, but are not limited to, a liquid crystal and an organic electro-luminescence (EL). The display device 106 may be a liquid crystal display with a touch panel function. In this case, the operation device 105 includes an interface circuit that acquires input signals from the touch panel.

Figure 2:
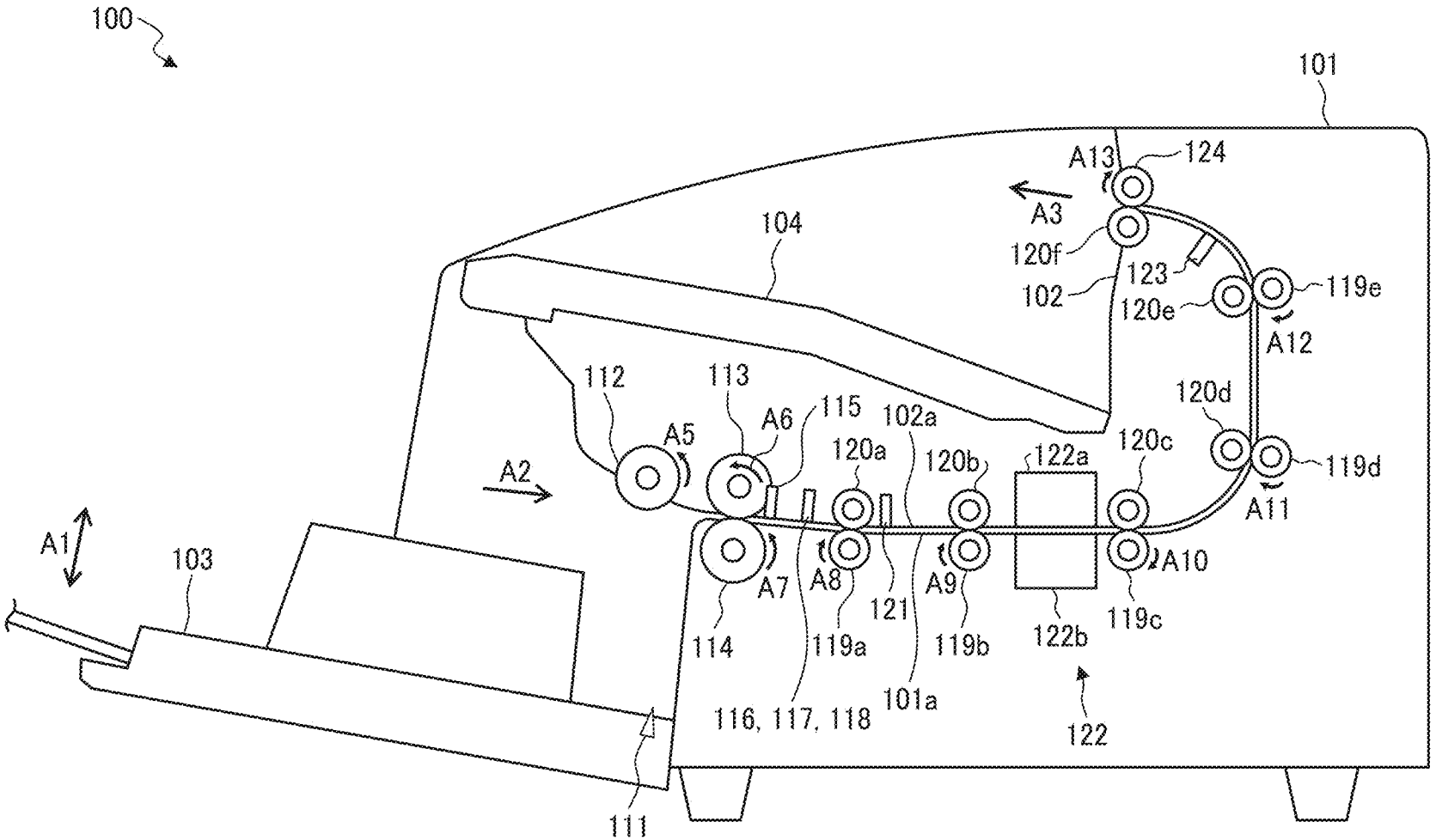
FIG. 2 is a diagram illustrating a conveyance passage inside the media ejection apparatus of FIG. 1.

FIG. 2 is a diagram illustrating a conveyance passage inside the media ejecting apparatus 100.

For example, the media ejecting apparatus 100 includes, along a conveyance passage, a feed table sensor 111, a pick roller 112, a feed roller 113, a separation roller 114, a separation sensor 115, a pick sensor 116, a first skew sensor 117, a second skew sensor 118, first to fifth conveyance rollers 119*a* to 119*e*, first to sixth driven rollers 120*a* to 120*f*, a feed sensor 121, an imaging device 122, an ejection sensor 123, and an ejection roller 124.

The pick roller 112 and/or the feed roller 113 are examples of conveyance rollers that convey media. The number of each of the pick roller 112, the feed roller 113, the separation roller 114, the first to fifth conveyance rollers 119*a* to 119*e*, the first to sixth driven rollers 120*a* to 120*f*, and/or the ejection roller 124 is not limited to one but may be two or more. In this case, the two or more rollers of the feed rollers 113, the separation rollers 114, the first to fifth conveyance rollers 119*a* to 119*e*, the first to sixth driven rollers 120*a* to 120*f*, and/or the ejection rollers 124 are aligned and spaced apart in the width direction A4 orthogonal to the media conveyance direction A2.

The second housing 102 faces the first housing 101 across a media conveyance passage through which media are conveyed. The first housing 101 has a face that faces the second housing 102. The face of the first housing 101 serves a first guide 101*a* of the media conveyance passage. The second housing 102 has a face that faces the first housing 101. The face of the second housing 102 serves a second guide 102*a* of the media conveyance passage. The first guide 101*a* and the second guide 102*a* define a so-called U-turn path.

The feed table sensor 111 is disposed on the feed table 103, that is, upstream from the feed roller 113 and the separation roller 114 in the media conveyance direction A2, to detect how the medium is placed on the feed table 103. The feed table sensor 111 determines whether a medium is placed on the feed table 103, with a contact sensor that causes a predetermined current to flow when a medium is in contact with the contact sensor or when no medium is in contact with the contact sensor. The feed table sensor 111 generates and outputs a feed table signal whose signal value changes between when a medium is placed on the feed table 103 and when no medium is placed on the feed table 103. The feed table sensor 111 is not limited to the contact sensor but may be any other sensor that can detect the presence of a medium such as an optical sensor.

The pick roller 112 is disposed upstream from the feed roller 113 and the separation roller 114 in the media conveyance direction A2 in the second housing 102. The pick roller 112 contacts the uppermost medium of the media placed on the feed table 103 that has been raised to substantially the same height as the height of the media conveyance passage, and feeds (conveys) the medium downstream in the media conveyance direction A2.

The feed roller 113 is disposed downstream from the pick roller 112 in the media conveyance direction A2 in the second housing 102 to further feed (convey) the medium fed (conveyed) from the feed table 103 by the pick roller 112 downstream in the media conveyance direction A2. The separation roller 114 faces the feed roller 113 in the first housing 101. The separation roller 114 is a so-called brake roller or retard roller. The separation roller 114 is stoppable or rotatable in a direction opposite to a media feeding direction in which media are fed. The feed roller 113 and the separation roller 114 function as separators that perform a separation operation of media. Specifically, the feed roller 113 and the separation roller 114 separate the media to feed the media one by one. The feed roller 113 is disposed above the separation roller 114. With this configuration, the media ejecting apparatus 100 feeds media from the top.

The first to fifth conveyance rollers 119*a* to 119*e* and the first to fifth driven rollers 120*a* to 120*e* are disposed downstream from the pick roller 112, the feed roller 113, and the separation roller 114 in the media conveyance direction A2 such that the first to fifth conveyance rollers 119*a* to 119*e* face the first to fifth driven rollers 120*a* to 120*e*, respectively. The first to fifth conveyance rollers 119*a* to 119*e* and the first to fifth driven rollers 120*a* to 120*e* convey the medium, that has been fed by the feed roller 113 and the separation roller 114, downstream in the media conveyance direction A2 or the media ejection direction A3.

The imaging device 122 is disposed downstream from the first and second conveyance rollers 119*a* and 119*b* in the media conveyance direction A2 to image the medium conveyed by the first and second conveyance rollers 119*a* and 119*b* and the first and second driven rollers 120*a* and 120*b*. The imaging device 122 includes a first imaging device 122*a* and a second imaging device 122*b* facing each other across the media conveyance passage. The first imaging device 122*a* is disposed in the second housing 102, whereas the second imaging device 122*b* is disposed in the first housing 101.

The first imaging device 122*a* includes, as a line sensor, a contact image sensor (CIS) employing an equal-magnification optical system and including, as imaging elements, complementary metal oxide semiconductors (CMOSs) aligned linearly in the main-scanning direction. The first imaging device 122*a* further includes a lens that forms an image on the imaging elements and an analog-to-digital (A/D) converter. The A/D converter amplifies the electric signals output from the imaging elements and performs analog-to-digital (A/D) conversion. The first imaging device 122*a* images the front side of the medium being conveyed, generates an input image, and outputs the input image.

Similarly, the second imaging device 122*b* includes, as a line sensor, a CIS employing the equal-magnification optical system and including, as imaging elements, CMOSs aligned linearly in the main-scanning direction. The second imaging device 122*b* further includes a lens that forms an image on the imaging elements and an A/D converter. The A/D converter amplifies the electric signals output from the imaging elements and performs A/D conversion. The second imaging device 122*b* images the back side of the medium being conveyed, generates an input image, and outputs the input image.

Alternatively, the media ejecting apparatus 100 may include either the first imaging device 122*a* or the second imaging device 122*b* to read only one side of the medium. The line sensor may be, instead of the CIS employing the equal-magnification optical system and including CMOSs as imaging elements, a CIS employing the equal-magnification optical system and including charge-coupled devices (CCDs) as imaging elements. Alternatively, a line sensor employing a reduction optical system and including, as imaging elements, CMOSs or CCDs may be used.

The ejection roller 124 and the sixth driven roller 120*f* face each other downstream from the first to fifth conveyance rollers 119*a* to 119*e* and the first to fifth driven rollers 120*a* to 120*e* in the media conveyance direction A2. The ejection roller 124 and the sixth driven roller 120*f* eject the medium conveyed by the pick roller 112, the feed roller 113, the separation roller 114, the first to fifth conveyance rollers 119*a* to 119*e*, and the first to fifth driven rollers 120*a* to 120*e* onto the ejection table 104.

As the pick roller 112 and the feed roller 113 rotate in media feeding directions A5 and A6, respectively, the medium is conveyed from the feed table 103 in the media conveyance direction A2 between the first guide 101*a* and the second guide 102*a*. On the other hand, the separation roller 114 stops or rotates in a direction indicated by arrow A7, that is, in the direction opposite to the media feeding direction to prevent the feeding of a medium other than the separated medium. In short, the multiple feeding is prevented.

As the first and second conveyance rollers 119*a* and 119*b* rotate in the directions indicated by arrows A8 and A9, respectively, the medium is fed to the imaging position in the imaging device 122 while being guided by the first guide 101*a* and the second guide 102*a*. At the imaging portion, the imaging device 122 images the medium. As the third to fifth conveyance rollers 119*c* to 119*e* and the ejection roller 124 rotate in the directions indicated by arrows A10 to A13, respectively, the medium is ejected onto the ejection table 104.

Figure 3:
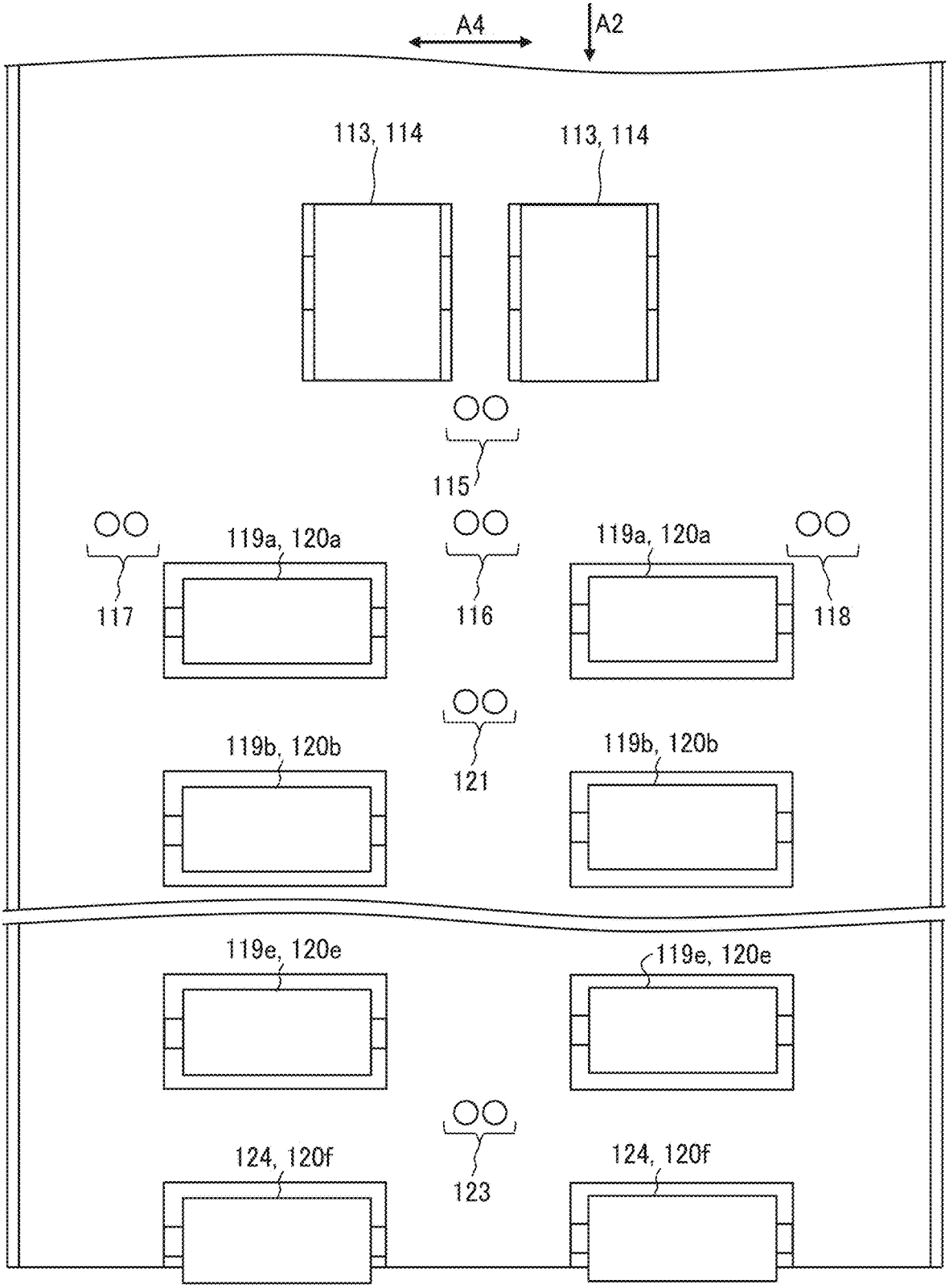
FIG. 3 is a schematic diagram illustrating an example of sensors.

FIG. 3 is a schematic diagram illustrating an example of sensors. Specifically, FIG. 3 is an inside view (from where the second housing 102 is present) around the media conveyance passage.

In the example illustrated in FIG. 3, two feed rollers 113, two separation rollers 114, two first to fifth conveyance rollers 119*a* to 119*e* each, two first to sixth driven rollers 120*a* to 120*f* each, and two ejection rollers 124 are provided.

The separation sensor 115 is disposed downstream from the feed rollers 113 and the separation rollers 114 and upstream from the first conveyance rollers 119*a* and the first driven rollers 120*a* in the media conveyance direction A2. In particular, the separation sensor 115 is disposed near the feed rollers 113 and the separation rollers 114. The separation sensor 115 is disposed upstream from the pick sensor 116, the first skew sensor 117, and the second skew sensor 118 in the media conveyance direction A2. The separation sensor 115 is disposed at the center, particularly between the two feed rollers 113 (between the two separation rollers 114) in the width direction A4.

The separation sensor 115 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, a light emitting diode (LED) and emits light toward the media conveyance passage. By contrast, the light receiver is, for example, a photodiode and receives light that is emitted by the light emitter and guided by the light guide tube. Based on the intensity of the light received by the light receiver, the separation sensor 115 generates and outputs a separation signal whose signal value changes between when a medium is present at the position of the separation sensor 115 and when a medium is absent at the position of the separation sensor 115. Thus, the separation sensor 115 detects the medium conveyed to the position of the separation sensor 115.

The pick sensor 116 is an example of a sensor. The pick sensor 116 is disposed downstream from the feed rollers 113 and the separation rollers 114 and upstream from the first conveyance rollers 119*a* and the first driven rollers 120*a* in the media conveyance direction A2. In particular, the pick sensor 116 is disposed downstream from the separation sensor 115 and at the same position as the first skew sensor 117 and the second skew sensor 118 in the media conveyance direction A2. Alternatively, the pick sensor 116 may be disposed upstream or downstream from the first skew sensor 117 and the second skew sensor 118 in the media conveyance direction A2 The pick sensor 116 is disposed at the center, particularly between the two feed rollers 113 and/or between the two first conveyance rollers 119*a* in the width direction A4. The pick sensor 116 is disposed between the first skew sensor 117 and the second skew sensor 118 in the width direction A4.

The pick sensor 116 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the pick sensor 116 generates and outputs a pick signal whose signal value changes between when a medium is present at the position of the pick sensor 116 and when a medium is absent at the position of the pick sensor 116. Thus, the pick sensor 116 detects the medium conveyed to the position of the pick sensor 116.

The first skew sensor 117 and the second skew sensor 118 are disposed downstream from the feed rollers 113 and the separation rollers 114 and upstream from the first conveyance rollers 119*a* and the first driven rollers 120*a* in the media conveyance direction A2. In particular, the first skew sensor 117 and the second skew sensor 118 are disposed downstream from the separation sensor 115 in the media conveyance direction A2. The first skew sensor 117 and the second skew sensor 118 are aligned and spaced apart in the width direction A4, at the same position when viewed in the width direction A4, that is, at mutually the same position in the media conveyance direction A2. The first skew sensor 117 is disposed to the left (left side in FIG. 3) of the center position in the width direction A4 when viewed in the direction opposite to the media conveyance direction A2. The second skew sensor 118 is disposed to the right (right side in FIG. 3) of the center position in the width direction A4 when viewed in the direction opposite to the media conveyance direction A2.

The first skew sensor 117 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the first skew sensor 117 generates and outputs a first skew signal whose signal value changes between when a medium is present at the position of the first skew sensor 117 and when a medium is absent at the position of the first skew sensor 117. Thus, the first skew sensor 117 detects the medium conveyed to the position of the first skew sensor 117.

The second skew sensor 118 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the second skew sensor 118 generates and outputs a second skew signal whose signal value changes between when a medium is present at the position of the second skew sensor 118 and when a medium is absent at the position of the second skew sensor 118. Thus, the second skew sensor 118 detects the medium conveyed to the position of the second skew sensor 118.

The feed sensor 121 is disposed downstream from the first conveyance rollers 119*a* and the first driven rollers 120*a* and upstream from the second conveyance rollers 119*b* and the second driven rollers 120*b* in the media conveyance direction A2. Alternatively, the feed sensor 121 may be disposed downstream from the second conveyance rollers 119*b* and the second driven rollers 120*b* and upstream from the imaging device 122 in the media conveyance direction A2. The feed sensor 121 is disposed at the center, particularly between the two feed rollers 113, between the two first conveyance rollers 119*a*, and/or between the two second conveyance rollers 119*b* in the width direction A4.

The feed sensor 121 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the feed sensor 121 generates and outputs a feed signal whose signal value changes between when a medium is present at the position of the feed sensor 121 and when a medium is absent at the position of the feed sensor 121. Thus, the feed sensor 121 detects the medium conveyed to the position of the feed sensor 121.

The ejection sensor 123 is disposed downstream from the fifth conveyance rollers 119*e* and the fifth driven rollers 120*e* and upstream from the ejection rollers 124 and the sixth driven rollers 120*f* in the media conveyance direction A2. The ejection sensor 123 is disposed at the center, particularly between the two feed rollers 113, between the two fifth conveyance rollers 119*e*, and/or between the two ejection rollers 124 in the width direction A4.

The ejection sensor 123 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the ejection sensor 123 generates and outputs an ejection signal whose signal value changes between when a medium is present at the position of the ejection sensor 123 and when a medium is absent at the position of the ejection sensor 123. Thus, the ejection sensor 123 detects the medium conveyed to the position of the ejection sensor 123.

In the separation sensor 115, the pick sensor 116, the first skew sensor 117, the second skew sensor 118, the feed sensor 121, and/or the ejection sensor 123, a reflector such as a mirror may be used instead of the light guide tube. In each of the aforementioned sensors, the light emitter and the light receiver may face each other across the media conveyance passage. Each of the aforementioned sensors may detect the presence of the medium with a contact sensor that causes a predetermined current to flow when a medium is in contact with the contact sensor or when no medium is in contact with the contact sensor.

Figure 4:
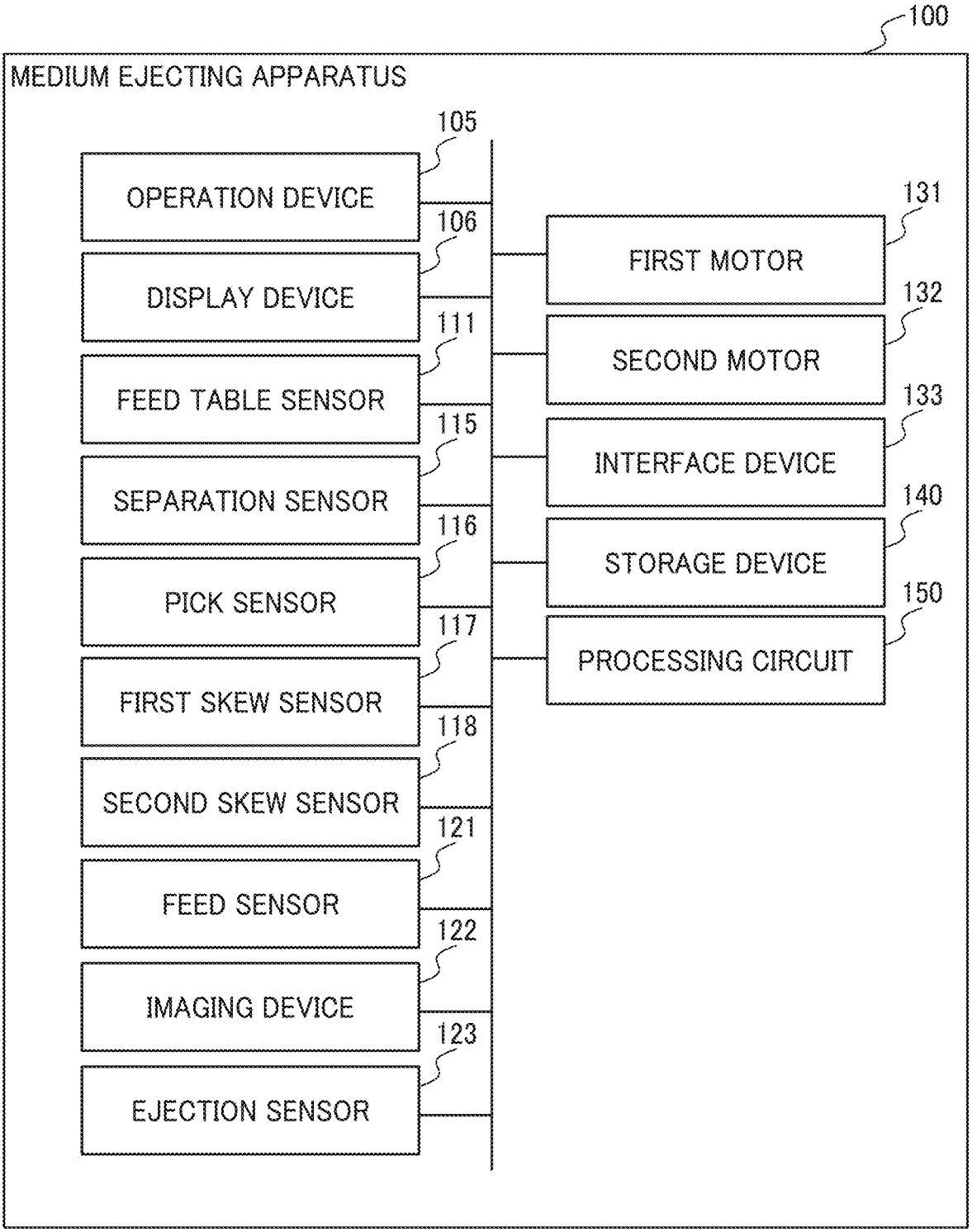
FIG. 4 is a schematic block diagram illustrating a configuration of the media ejecting apparatus of FIG. 1.

FIG. 4 is a schematic block diagram illustrating a configuration of the media ejecting apparatus 100.

The media ejecting apparatus 100 further includes, for example, a first motor 131, a second motor 132, an interface device 133, a storage device 140, and a processing circuit 150, in addition to the configuration described above.

The first motor 131 is an example of a conveyance motor that drives the conveyance rollers. The first motor 131 includes one or more motors. The first motor 131 generates driving forces for rotating the pick roller 112, the feed roller 113, the separation roller 114, and the first to fifth conveyance rollers 119*a* to 119*e* in response to control signals from the processing circuit 150 to feed and convey media. The first to fifth driven rollers 120*a* to 120*e* may be rotated by the driving force from the first motor 131, instead of rotating in accordance with the rotation of the first to fifth conveyance rollers 119*a* to 119*e*. The motor included in the first motor 131 moves the feed table 103 in response to a control signal from the processing circuit 150.

The second motor 132 is an example of an ejection motor that drives the ejection roller 124. The second motor 132 includes one or more motors. The second motor 132 generates driving forces for rotating the ejection roller 124 in response to control signals from the processing circuit 150 to eject a medium. The sixth driven roller 120*f* may be rotated by the driving force from the second motor 132, instead of rotating in accordance with the rotation of the ejection roller 124.

As described above, the media ejecting apparatus 100 includes, as separate motors, the first motor 131 that drives the pick roller 112, the feed roller 113, the separation roller 114, and/or the first to fifth conveyance rollers 119*a* to 119*e*, and the second motor 132 that drives the ejection roller 124. Thus, while ejecting a specific medium, the media ejecting apparatus 100 can change the ejection speed for ejecting the specific medium without changing the conveyance speed for conveying another medium being conveyed or imaged. In short, the media ejecting apparatus 100 can appropriately change the ejection speed for ejecting media while sequentially conveying the media.

The interface device 133 includes an interface circuit in compliance with a serial bus such as a universal serial bus (USB) and is electrically connected to an information processing device (for example, a personal computer or a mobile information processing terminal) to transmit and receive an input image and various kinds of information to and from the information processing device. The interface device 133 may be substituted by a communication device including an antenna to transmit and receive radio signals and a wireless communication interface circuit to transmit and receive the signals through a wireless communication line according to a predetermined communication protocol. The predetermined communication protocol is, for example, a wireless local area network (LAN) communication protocol. The communication device may include a wired communication interface circuit to transmit and receive signals through a wired communication line according to, for example, a wired LAN communication protocol.

The storage device 140 includes memories such as a random-access memory (RAM) and a read-only memory (ROM); a fixed disk device such as a hard disk; or a portable memory such as a flexible disk or an optical disk. The storage device 140 stores, for example, computer programs, databases, and tables used for various processes performed by the media ejecting apparatus 100. The computer programs may be installed in the storage device 140 from a computer-readable portable recording medium using, for example, a known setup program. The portable recording medium is, for example, a compact disc read-only memory (CD-ROM) or a digital versatile disc read-only memory (DVD-ROM). The computer program may be distributed from, for example, a server and installed in the storage device 140.

The processing circuit 150 operates according to a program prestored in the storage device 140. The processing circuit 150 is, for example, a central processing unit (CPU). Alternatively, as the processing circuit 150, for example, a digital signal processor (DSP), a large scale integration (LSI), an application-specific integrated circuit (ASIC), or a field-programmable gate array (FPGA) may be used.

The processing circuit 150 is connected to, for example, the operation device 105, the display device 106, the feed table sensor 111, the separation sensor 115, the pick sensor 116, the first skew sensor 117, the second skew sensor 118, the feed sensor 121, the imaging device 122, the ejection sensor 123, the first motor 131, the second motor 132, the interface device 133, and the storage device 140, and controls these components. The processing circuit 150 controls, for example, the driving of the first motor 131 and the second motor 132, and the imaging by the imaging device 122, based on the signals received from the sensors described above. The processing circuit 150 acquires an input image from the imaging device 122 and transmits the input image to the information processing device via the interface device 133.

Figure 5:
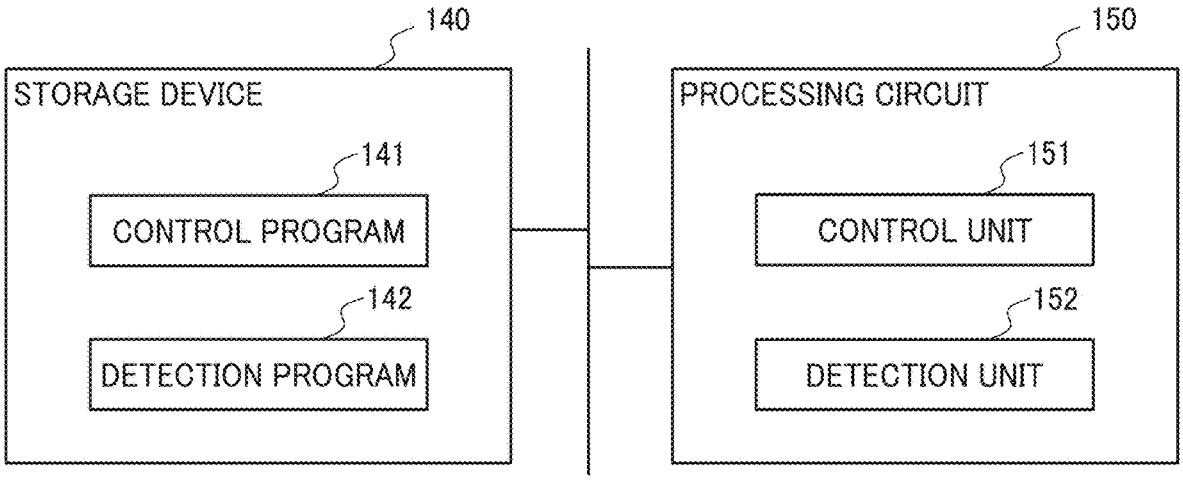
FIG. 5 is a schematic block diagram illustrating a configuration of a storage device and a processing circuit included in the media ejecting apparatus of FIG. 1.

FIG. 5 is a schematic block diagram illustrating a configuration of the storage device 140 and the processing circuit 150.

As illustrated in FIG. 5, the storage device 140 stores, for example, a control program 141 and a detection program 142. These programs are functional modules implemented by software operating on the processor. The processing circuit 150 reads the programs from the storage device 140 and operates according to the read programs. Thus, the processing circuit 150 functions as a control unit 151 and a detection unit 152.

Figure 6:
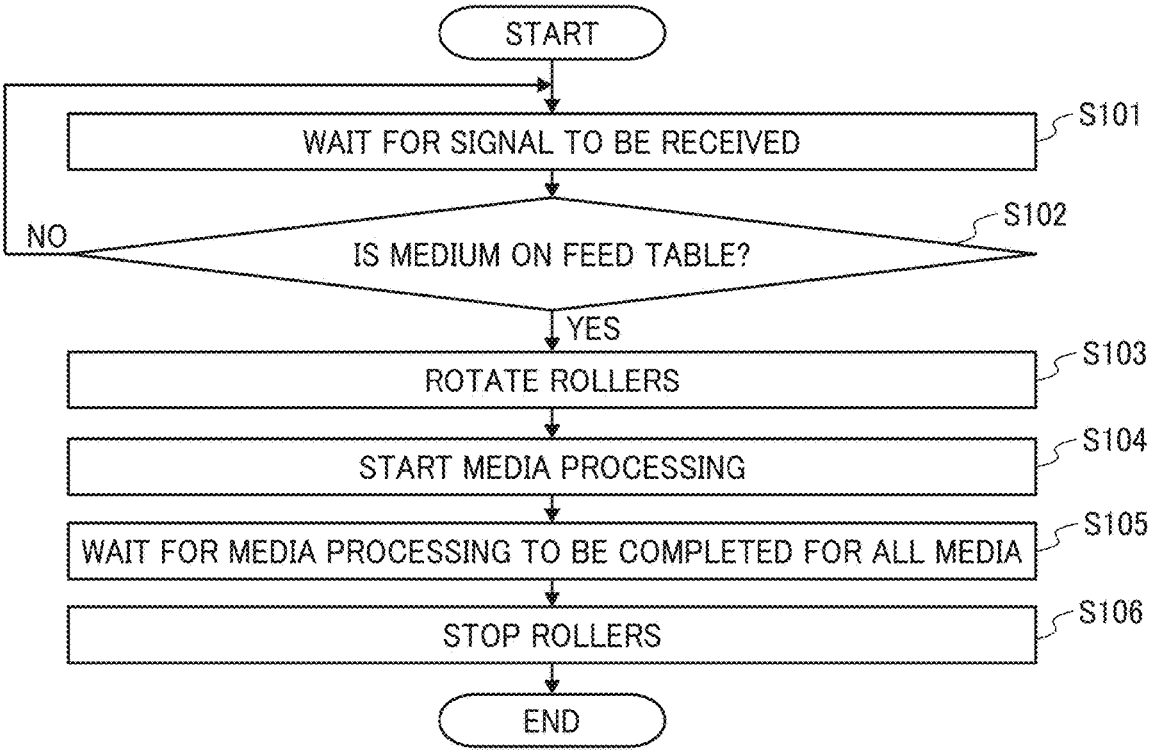
FIG. 6 is a flowchart of an example of overall processing.

FIG. 6 is a flowchart of an example of overall processing performed by the media ejecting apparatus 100.

A description is given below of an example of overall processing performed by the media ejecting apparatus 100, with reference to the flowchart of FIG. 6. The operation process described below is executed, for example, by the processing circuit 150 in cooperation with the components of the media ejecting apparatus 100 according to the program prestored in the storage device 140.

In step S101, the control unit 151 waits until the control unit 151 receives an operation signal instructing the reading of media from the operation device 105 or the interface device 133. The operation signal is output when the user inputs an instruction to read media using the operation device 105 or the information processing device.

In step S102, the control unit 151 acquires a feed table signal from the feed table sensor 111 and determines whether a medium is placed on the feed table 103, based on the acquired feed table signal. When no medium is placed on the feed table 103 (NO in step S102), the control unit 151 returns to step S101. The control unit 151 waits until the control unit 151 receives a new operation signal from the operation device 105 or the interface device 133.

By contrast, when a medium is placed on the feed table 103 (YES in step S102), in step S103, the control unit 151 drives the first motor 131 to move the feed table 103 to the position where the medium can be fed. The control unit 151 also drives the first motor 131 to rotate the pick roller 112, the feed roller 113, the separation roller 114, the first to fifth conveyance rollers 119*a* to 119*e*, and/or the first to fifth driven rollers 120*a* to 120*e*. The control unit 151 also drives the second motor 132 to rotate the ejection roller 124 and/or the sixth driven roller 120*f*. Thus, the control unit 151 feeds and conveys the medium from the feed table 103. At this time, the control unit 151 sets the ejection speed at which the ejection roller 124 ejects a medium to a reference speed.

In step S104, the control unit 151 starts media processing on the medium that has started to be fed and conveyed. The media processing is executed for each medium to be fed and conveyed. The media processing on the second and subsequent media is started during the media processing on the medium that is fed and conveyed immediately before each medium. A detailed description of the media processing is deferred.

In step S105, the control unit 151 waits until the media processing is completed for all the media placed on the feed table 103.

In step S106, the control unit 151 controls the first motor 131 and the second motor 132 to stop the rollers rotated in step S103 and return the feed table 103 to the initial position. Thus, the series of steps ends.

Figure 7:
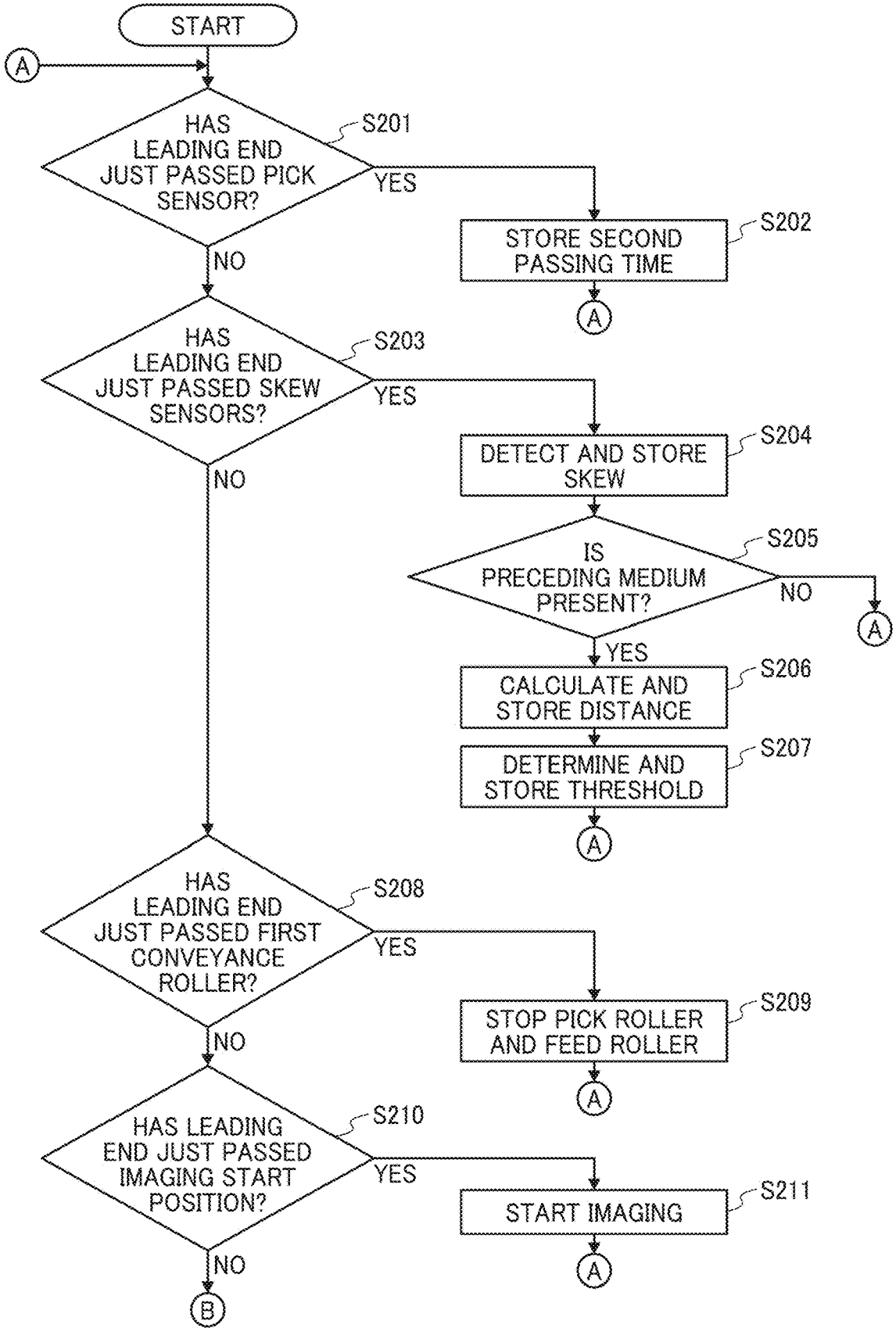
FIG. 7 is a flowchart of an example of media processing.
Figure 8:
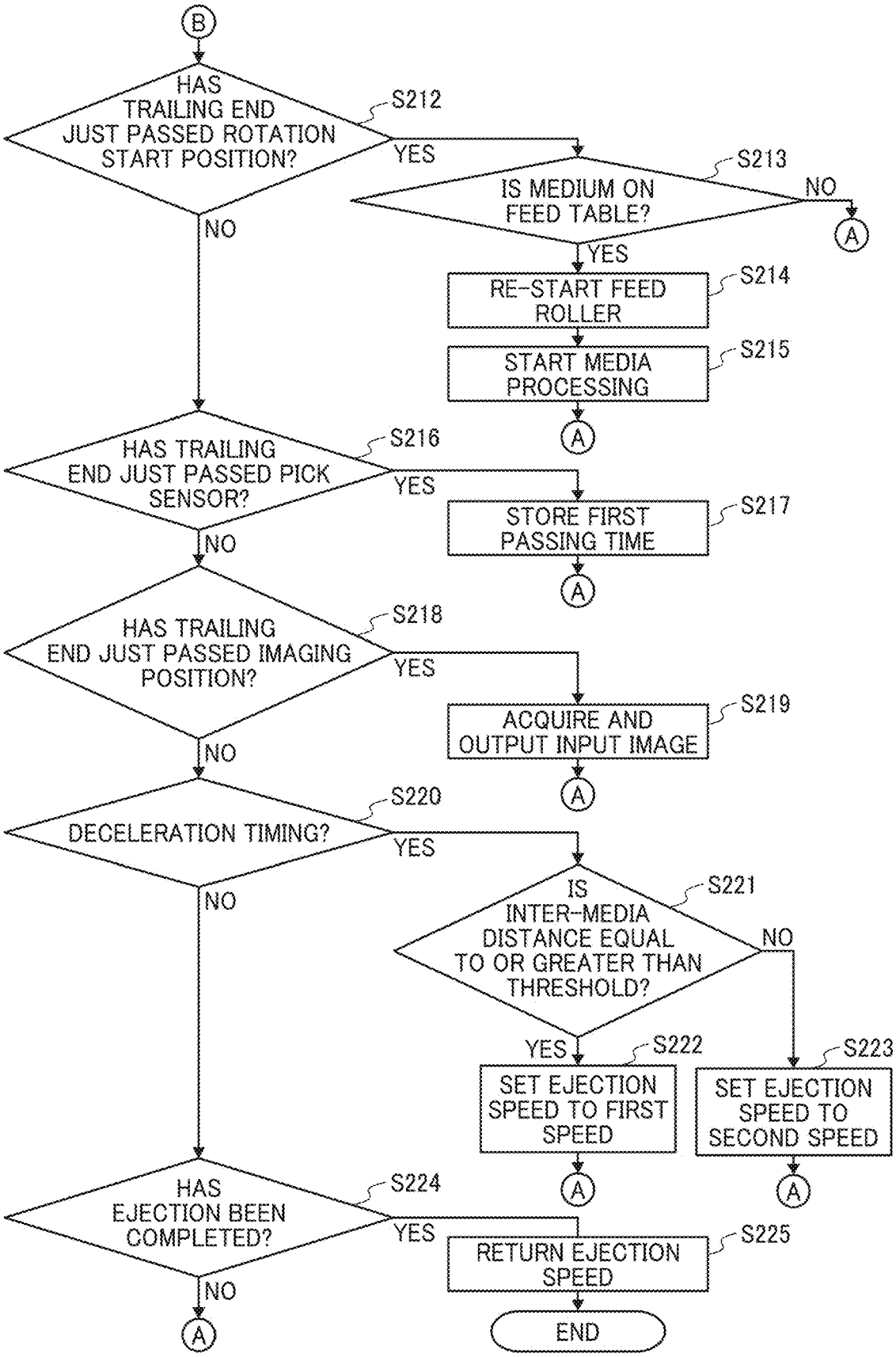
FIG. 8 is a continuation of the flowchart of FIG. 7.

FIG. 7 is a flowchart of an example of the media processing. FIG. 8 is a continuation of the flowchart of FIG. 7. The media processing on a medium that is fed and conveyed first among the media placed on the feed table 103 is started in step S104 of FIG. 6. The media processing on the other media that are fed and conveyed thereafter is started during the media processing on the medium that is fed and conveyed immediately before each medium. In the following description, a medium to be subjected to the media processing may be referred to as a target medium, a medium that is fed and conveyed immediately before the target medium may be referred to as a preceding medium that precedes the target medium, and a medium that is fed and conveyed immediately after the target medium may be referred to as a following medium that follows the target medium. The combination of the preceding medium and the target medium or the combination of the target medium and the following medium is an example of the combination of a first medium and a second medium.

In step S201, the control unit 151 determines whether the leading end of the target medium has just passed the position of the pick sensor 116 for the first time. The control unit 151 periodically acquires the pick signal from the pick sensor 116. When the signal value of the pick signal changes from a value indicating that a medium is absent to a value indicating that a medium is present, the control unit 151 determines that the leading end of the medium has just passed the position of the pick sensor 116 and the pick sensor 116 has just detected the leading end of the medium.

When the leading end of the target medium has just passed the position of the pick sensor 116 for the first time (YES in step S201), in step S202, the control unit 151 stores the time when the leading end of the target medium passes the position of the pick sensor 116 in the storage device 140 as a second passing time. Then, the control unit 151 returns to step S201.

By contrast, when the leading end of the target medium has not passed the position of the pick sensor 116 yet or has already passed the position of the pick sensor 116 (NO in step S201), in step S203, the control unit 151 determines whether the leading end of the target medium has just passed both the position of the first skew sensor 117 and the position of the second skew sensor 118 for the first time. The control unit 151 periodically acquires the first skew signal and the second skew signal from the first skew sensor 117 and the second skew sensor 118. When the signal value of the first skew signal changes from a value indicating that a medium is absent to a value indicating that a medium is present, the control unit 151 determines that the leading end of the medium has just passed the position of the first skew sensor 117 and the first skew sensor 117 has just detected the leading end of the medium. The control unit 151 stores the time when the leading end of the target medium passes the position of the first skew sensor 117 in the storage device 140 as a first-skew-sensor passing time. When the signal value of the second skew signal changes from a value indicating that a medium is absent to a value indicating that a medium is present, the control unit 151 determines that the leading end of the medium has just passed the position of the second skew sensor 118 and the second skew sensor 118 has just detected the leading end of the medium. The control unit 151 stores the time when the leading end of the target medium passes the position of the second skew sensor 118 in the storage device 140 as a second-skew-sensor passing time.

When the leading end of the target medium has just passed both the position of the first skew sensor 117 and the position of the second skew sensor 118 for the first time (YES in step S203), in step S204, the detection unit 152 detects the skew of the target medium conveyed by the conveyance rollers and stores the detected skew in the storage device 140. The detection unit 152 detects the skew of the target medium based on the results of detection performed by the first skew sensor 117 and the second skew sensor 118.

The detection unit 152 calculates a multiplication value by multiplying a subtraction value, which is obtained by subtracting the second-skew-sensor passing time from the first-skew-sensor passing time stored in the storage device 140, by the speed at which the feed roller 113 feeds media. The multiplication value corresponds to the deviation of the leading end of the medium relative to the media conveyance direction A2 at the position of the first skew sensor 117 and the position of the second skew sensor 118. Subsequently, the detection unit 152 calculates, as a tangent of the skew angle of the leading end of the medium, a division value by dividing the calculated multiplication value by the distance between the position of the first skew sensor 117 and the position of the second skew sensor 118 in the width direction A4. Subsequently, the detection unit 152 calculates an arctangent of the calculated tangent as the skew angle of the medium. The subtraction value, the multiplication value, the tangent, and the skew angle described above can take positive values and negative values. In other words, when the part proximate to the second skew sensor 118 at the leading end of the medium precedes the rest at the leading end of the medium, each of the subtraction value, the multiplication value, the tangent, and the skew angle is a positive value. By contrast, when the part proximate to the first skew sensor 117 at the leading end of the medium precedes the rest at the leading end of the medium, each of the subtraction value, the multiplication value, the tangent, and the skew angle is a negative value. The detection unit 152 detects the calculated skew angle as the skew of the medium. Alternatively, the detection unit 152 may detect, as the skew of the medium, the calculated tangent, the calculated multiplication value, or the calculated subtraction value.

The detection unit 152 may detect the skew of the medium based on the results of detection performed by the separation sensor 115, the pick sensor 116, the first skew sensor 117, and the second skew sensor 118. In this case, the control unit 151 periodically acquires the separation signal from the separation sensor 115. When the signal value of the separation signal changes from a value indicating that a medium is absent to a value indicating that a medium is present, the control unit 151 determines that the leading end of the medium has just passed the position of the separation sensor 115 and the separation sensor 115 has just detected the leading end of the medium. The control unit 151 stores the time when the leading end of the medium passes the position of the separation sensor 115 in the storage device 140.

When the separation sensor 115, the pick sensor 116, the second skew sensor 118, and the first skew sensor 117 detect the leading end of the medium in this order, the detection unit 152 detects, as the skew of the medium, a first skew having a positive value. When the separation sensor 115, the second skew sensor 118, the pick sensor 116, and the first skew sensor 117 detect the leading end of the medium in this order, the detection unit 152 detects, as the skew of the medium, a second skew having a positive value and being larger in absolute value than the first skew. When the second skew sensor 118, the separation sensor 115, the pick sensor 116, and the first skew sensor 117 detect the leading end of the medium in this order, the detection unit 152 detects, as the skew of the medium, a third skew having a positive value and being larger in absolute value than the second skew. When the separation sensor 115, the pick sensor 116, the first skew sensor 117, and the second skew sensor 118 detect the leading end of the medium in this order, the detection unit 152 detects, as the skew of the medium, a fourth skew having a negative value and being equal in absolute value to the first skew. When the separation sensor 115, the first skew sensor 117, the pick sensor 116, and the second skew sensor 118 detect the leading end of the medium in this order, the detection unit 152 detects, as the skew of the medium, a fifth skew having a negative value and being equal in absolute value to the second skew. When the first skew sensor 117, the separation sensor 115, the pick sensor 116, and the second skew sensor 118 detect the leading end of the medium in this order, the detection unit 152 detects, as the skew of the medium, a sixth skew having a negative value and being equal in absolute value to the third skew.

Subsequently, in step S205, the control unit 151 determines whether a preceding medium is present. In other words, the control unit 151 determines whether the target medium is a first medium that is fed and conveyed first or a second or subsequent medium that is fed and conveyed after the first or subsequent medium. When no preceding medium is present, that is, when the target medium is the first medium (NO in step S205), the control unit 151 returns to step S201.

By contrast, when a preceding medium is present, that is, when the target medium is the second or subsequent medium (YES in step S205), in step S206, the control unit 151 calculates an inter-media distance between the target medium and the preceding medium and stores the calculated inter-media distance in the storage device 140. The control unit 151 calculates, as the inter-media distance, the distance between the leading end of the target medium and the trailing end of the preceding medium in the media conveyance direction A2 at the position of the pick sensor 116. The control unit 151 calculates, as the inter-media distance, a multiplication value by multiplying a subtraction value, which is obtained by subtracting a first passing time of the preceding medium from the second passing time of the target medium stored in the storage device 140, by the speed at which the feed roller 113 feeds media. The second passing time of the target medium is stored when the leading end of the target medium passes the position of the pick sensor 116 in step S202 of the media processing (currently in progress) on the target medium. The first passing time of the preceding medium is stored when the trailing end of the preceding medium passes the position of the pick sensor 116 in step S213, which is described later, of the media processing on the preceding medium.

Subsequently, in step S207, the control unit 151 determines a threshold to be compared with the inter-media distance to determine whether to reduce the ejection speed at which the ejection roller 124 ejects the preceding medium and stores the determined threshold in the storage device 140. Then, the control unit 151 returns to step S201. The threshold is an example of the reference for determining whether to reduce the ejection speed at which the ejection roller 124 ejects the preceding medium.

The control unit 151 changes the threshold based on the skew of the medium detected by the detection unit 152. For example, the control unit 151 changes the threshold based on the skew of the target medium. The control unit 151 may change the threshold based on the skew of the preceding medium. The control unit 151 may change the threshold based on the relationship between the skew of the target medium and the skew of the preceding medium. In this case, the control unit 151 calculates, as the skew of the target medium relative to the preceding medium, a subtraction value by subtracting the skew of the preceding medium from the skew of the target medium. The control unit 151 may calculate, as the skew of the preceding medium relative to the target medium, a subtraction value by subtracting the skew of the target medium from the skew of the preceding medium. The control unit 151 changes the threshold based on the skew of the target medium, the skew of the preceding medium, or the relationship between the skew of the target medium and the skew of the preceding medium. Thus, the control unit 151 changes the reference for determining whether to reduce the ejection speed at which the ejection roller 124 ejects the preceding medium.

FIGS. 9A to 9D are schematic diagrams each illustrating the relationship between the skew of media and the inter-media distance. Each of FIGS. 9A to 9D illustrates the preceding medium as a medium M1 and the target medium as a medium M2. A distance D1 is an inter-media distance between the leading end of the target medium M2 and the trailing end of the preceding medium M1 at the position of the pick sensor 116.

Figure 9A:
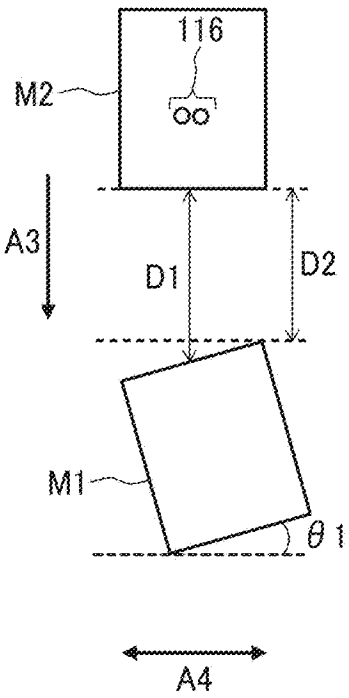
FIGS. 9A to 9D are schematic diagrams each illustrating the relationship between the skew of media and the distance between the media.

FIG. 9A illustrates the target medium M2 that is not skewed and the preceding medium M1 that is skewed at an angle θ1. As illustrated in FIG. 9A, since the preceding medium M1 is skewed, a shortest distance D2 between the leading end of the target medium M2 and the trailing end of the preceding medium M1 is smaller than the inter-media distance D1 at the position of the pick sensor 116. For this reason, when the speed at which the preceding medium M1 is ejected is reduced, the leading end of the target medium M2 may contact the trailing end of the preceding medium M1.

Figure 9B:
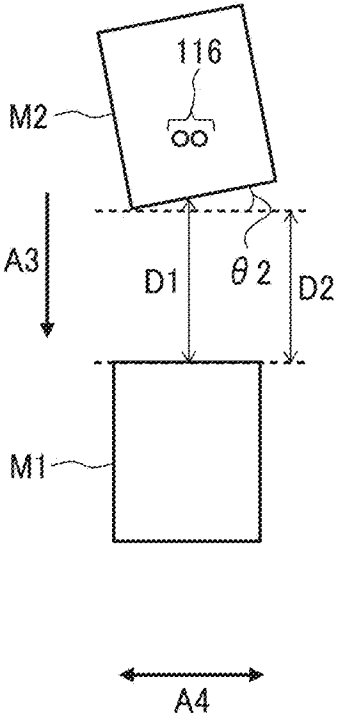

FIG. 9B illustrates the preceding medium M1 that is not skewed and the target medium M2 that is skewed at an angle θ2. As illustrated in FIG. 9B, when the target medium M2 is skewed, the shortest distance D2 between the leading end of the target medium M2 and the trailing end of the preceding medium M1 is smaller than the inter-media distance D1 at the position of the pick sensor 116. For this reason, when the speed at which the preceding medium M1 is ejected is reduced, the leading end of the target medium M2 may contact the trailing end of the preceding medium M1.

Figure 9C:
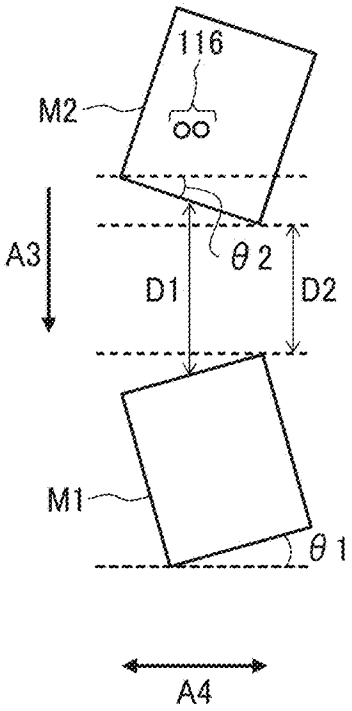

FIG. 9C illustrates the preceding medium M1 and the target medium M2 that are skewed in mutually different directions. When the preceding medium M1 and the target medium M2 are skewed in mutually different directions as illustrated in FIG. 9C, the shortest distance D2 between the leading end of the target medium M2 and the trailing end of the preceding medium M1 is extremely smaller than the inter-media distance D1 at the position of the pick sensor 116. For this reason, when the speed at which the preceding medium M1 is ejected is reduced, the leading end of the target medium M2 is likely to contact the trailing end of the preceding medium M1. The shortest distance D2 when the preceding medium M1 and the target medium M2 are skewed in mutually different directions is approximate to the shortest distance when one of the preceding medium M1 and the target medium M2 is skewed at the sum of the skew angle θ1 of the preceding medium M1 and the skew angle θ2 of the target medium M2.

Figure 9D:
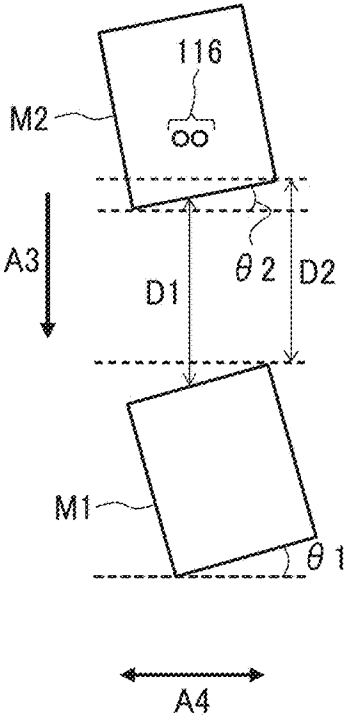

FIG. 9D illustrates the preceding medium M1 and the target medium M2 that are skewed in mutually the same direction. When the preceding medium M1 and the target medium M2 are skewed in mutually the same direction as illustrated in FIG. 9D, the difference is relatively small between the shortest distance D2 between the leading end of the target medium M2 and the trailing end of the preceding medium M1 and the inter-media distance D1 at the position of the pick sensor 116. For this reason, when the speed at which the preceding medium M1 is ejected is reduced, the leading end of the target medium M2 is unlikely to contact the trailing end of the preceding medium M1. The shortest distance D2 when the preceding medium M1 and the target medium M2 are skewed in mutually the same direction is approximate to the shortest distance when one of the preceding medium M1 and the target medium M2 is skewed at the difference between the skew angle θ1 of the preceding medium M1 and the skew angle θ2 of the target medium M2.

The control unit 151 sets the threshold such that the ejection speed at which the ejection roller 124 ejects a medium is more likely controlled so as not to be reduced as the skew of the medium is larger (in absolute value). In other words, the control unit 151 sets the threshold to have a larger value as the skew of the medium is larger. For example, the control unit 151 sets the threshold to a first value when the skew of the medium is equal to or less than a first skew threshold. The control unit 151 sets the threshold to a second value when the skew of the medium is larger than the first skew threshold and equal to or smaller than a second skew threshold. The control unit 151 sets the threshold to a third value when the skew of the medium is larger than the second skew threshold. The first skew threshold, the second skew threshold, the first value, the second value, and the third value are predetermined. The second skew threshold is set to a value larger than the first skew threshold. The second value is set to a value larger than the first value. The third value is set to a value larger than the second value.

Referring back to FIG. 7, when the leading end of the target medium has not passed the positions of the first skew sensor 117 and the second skew sensor 118 yet or has already passed the positions of the first skew sensor 117 and the second skew sensor 118 (NO in step S203), in step S208, the control unit 151 determines whether the leading end of the target medium has just passed the position of the first conveyance roller 119*a* for the first time. The control unit 151 periodically acquires the feed signal from the feed sensor 121. When the signal value of the feed signal changes from a value indicating that a medium is absent to a value indicating that a medium is present, the control unit 151 determines that the leading end of the medium has just passed the position of the feed sensor 121 and the feed sensor 121 has just detected the leading end of the medium. When the control unit 151 determines that the leading end of the medium has just passed the position of the feed sensor 121, the control unit 151 determines that the leading end of the medium has just passed the position of the first conveyance roller 119*a*.

When the leading end of the target medium has just passed the position of the first conveyance roller 119*a* for the first time (YES in step S208), in step S209, the control unit 151 controls the first motor 131 to stop the pick roller 112 and the feed roller 113. Then, the control unit 151 returns to step S201. Thereafter, the target medium is conveyed by the first to fifth conveyance rollers 119*a* to 119*e* and the ejection roller 124. The halt of the rotation of the feed roller 113 prevents the target medium from being pushed by the feed roller 113 and bent or the multiple feeding of the target medium and the following medium.

By contrast, when the leading end of the target medium has not passed the position of the first conveyance roller 119*a* yet or has already passed the position of the first conveyance roller 119*a* (NO in step S208), in step S210, the control unit 151 determines whether the leading end of the target medium has just passed the imaging start position for the first time. The imaging start position is set to, for example, a position between the second conveyance roller 119*b* and the imaging device 122. The control unit 151 determines that the leading end of the medium has just passed the imaging start position when a first given time has just elapsed after the leading end of the medium passes the position of the feed sensor 121. The first given time is set to the time taken for a medium to move from the position of the feed sensor 121 to the imaging start position.

When the leading end of the target medium has just passed the imaging start position for the first time (YES in step S210), in step S211, the control unit 151 causes the imaging device 122 to start imaging. Then, the control unit 151 returns to step S201.

By contrast, when the leading end of the target medium has not passed the imaging start position yet or has already passed the imaging start position (NO in step S210), in step S212, the control unit 151 determines whether the trailing end of the target medium has just passed the rotation start position of the feed roller 113 for the first time. The rotation start position is set to a position downstream from the feed roller 113 in the media conveyance direction A2. The control unit 151 periodically acquires the separation signal from the separation sensor 115. When the signal value of the separation signal changes from a value indicating that a medium is present to a value indicating that a medium is absent, the control unit 151 determines that the trailing end of the medium has just passed the position of the separation sensor 115 and the separation sensor 115 has just detected the trailing end of the medium. The control unit 151 determines that the trailing end of the medium has just passed the rotation start position when a second given time has just elapsed after the trailing end of the medium passes the position of the separation sensor 115. The second given time is set to the time taken for a medium to move from the position of the separation sensor 115 to the rotation start position. The rotation start position may be set to, for example, the position of the separation sensor 115 or the position of the pick sensor 116. In this case, the control unit 151 determines that the trailing end of the medium has just passed the rotation start position when the trailing end of the medium has just passed the position of the separation sensor 115 or the position of the pick sensor 116.

When the trailing end of the target medium has just passed the rotation start position of the feed roller 113 for the first time (YES in S212), in step S213, the control unit 151 acquires a feed table signal from the feed table sensor 111 and determines whether a medium remains on the feed table 103 based on the acquired feed table signal. When no medium remains on the feed table 103 (NO in step S213), the control unit 151 returns to step S201.

By contrast, when a medium remains on the feed table 103 (YES in step S213), in step S214, the control unit 151 controls the first motor 131 to re-rotate the pick roller 112 and the feed roller 113 to feed and convey the following medium.

Subsequently, in step S215, the control unit 151 starts media processing on the following medium. Then, the control unit 151 returns to step S201.

By contrast, when the trailing end of the target medium has not passed the rotation start position yet or has already passed the rotation start position (NO in step S212), in step S216, the control unit 151 determines whether the trailing end of the target medium has just passed the position of the pick sensor 116 for the first time. The control unit 151 periodically acquires the pick signal from the pick sensor 116. When the signal value of the pick signal changes from a value indicating that a medium is present to a value indicating that a medium is absent, the control unit 151 determines that the trailing end of the medium has just passed the position of the pick sensor 116 and the pick sensor 116 has just detected the trailing end of the medium.

When the trailing end of the target medium has just passed the position of the pick sensor 116 for the first time (YES in step S216), in step S217, the control unit 151 stores as the first passing time, the time when the trailing end of the target medium passes the position of the pick sensor 116 in the storage device 140. Then, the control unit 151 returns to step S201. The first passing time of the target medium is used to calculate the inter-media distance between the trailing end of the target medium and the leading end of the following medium in step S206 of the media processing on the following medium.

By contrast, when the trailing end of the target medium has not passed the position of the pick sensor 116 yet or has already passed the position of the pick sensor 116 (NO in step S216), in step S218, the control unit 151 determines whether the trailing end of the target medium has just passed through the imaging position in the imaging device 122 for the first time. The control unit 151 periodically acquires the feed signal from the feed sensor 121. When the signal value of the feed signal changes from a value indicating that a medium is present to a value indicating that a medium is absent, the control unit 151 determines that the trailing end of the medium has just passed the position of the feed sensor 121 and the feed sensor 121 has just detected the trailing end of the medium. The control unit 151 determines that the trailing end of the medium has just passed through the imaging position in the imaging device 122 when a third given time has just elapsed after the trailing end of the medium passes the position of the feed sensor 121. The third given time is set to the time taken for a medium to move from the position of the feed sensor 121 to the imaging position.

When the trailing end of the target medium has just passed through the imaging position for the first time (YES in step S218), in step S219, the control unit 151 causes the imaging device 122 to finish imaging, acquires an input image from the imaging device 122, and transmits (i.e., outputs) the acquired input image to the information processing device via the interface device 133. Then, the control unit 151 returns to step S201. The control unit 151 may acquire an image from the imaging device 122 each time the imaging device 122 generates an image of one or more lines extending in the main scanning direction and generate an input image by combining the images when the trailing end of the medium has just passed through the imaging position.

By contrast, when the trailing end of the target medium has not passed through the imaging position yet or has already passed through the imaging position (NO in step S218), in step S220, the control unit 151 determines whether the deceleration timing to reduce the ejection speed at which the ejection roller 124 ejects a medium has just been reached for the first time. The control unit 151 determines whether the deceleration timing has just been reached based on whether the trailing end of the medium has just passed the deceleration start position. The deceleration start position is set to a position between the fifth conveyance roller 119*e* and the ejection roller 124. The control unit 151 determines that the trailing end of the medium has just passed the deceleration start position when a fourth given time has just elapsed after the trailing end of the medium passes the position of the feed sensor 121. The fourth given time is set to the time taken for a medium to move from the position of the feed sensor 121 to the deceleration start position.

The deceleration start position may be set to a position between the ejection sensor 123 and the ejection roller 124. In this case, the control unit 151 periodically acquires the ejection signal from the ejection sensor 123. When the signal value of the ejection signal changes from a value indicating that a medium is present to a value indicating that a medium is absent, the control unit 151 determines that the trailing end of the medium has just passed the position of the ejection sensor 123 and the ejection sensor 123 has just detected the trailing end of the medium. The control unit 151 determines that the trailing end of the medium has just passed the deceleration start position when a fifth given time has just elapsed after the trailing end of the medium passes the position of the ejection sensor 123. The fifth given time is set to the time taken for a medium to move from the position of the ejection sensor 123 to the deceleration start position.

When the deceleration timing has just been reached for the first time (YES in step S220), in step S221, the control unit 151 determines whether the inter-media distance between the target medium and the following medium is equal to or larger than the threshold determined for the target medium. The inter-media distance between the target medium and the following medium is calculated and stored in the storage device 140 in step S206 of the media processing on the following medium. The threshold for the target medium is determined and stored in the storage device 140 in step S207 of the media processing on the following medium.

When the inter-media distance between the target medium and the following medium is equal to or larger than the threshold determined for the target medium (YES in step S221), in step S222, the control unit 151 sets the ejection speed at which the ejection roller 124 ejects a medium to a first speed lower than the reference speed. Then, the control unit 151 returns to step S201. The first speed is preset to a fixed value.

In this way, when the ejection roller 124 ejects the target medium, the control unit 151 reduces the ejection speed at which the ejection roller 124 ejects the target medium. Accordingly, the media ejecting apparatus 100 can prevent the medium from being ejected with great force and scattered on the ejection table 104 or flying out from the ejection table 104 and enhance the alignment of the ejected media. As a result, the user can easily align the ejected media. Thus, the media ejecting apparatus 100 enhances the convenience of the user.

In particular, when the inter-media distance between the target medium and the following medium detected by the pick sensor 116 is equal to or larger than the threshold, the control unit 151 reduces the ejection speed at which the ejection roller 124 ejects the target medium. By reducing the ejection speed for ejecting the target medium only when the inter-media distance between the target medium and the following medium is secured, the media ejecting apparatus 100 prevents the leading end of the following medium from contacting the trailing end of the preceding medium and changing the speed of the following medium. As a result, the media ejecting apparatus 100 can prevent the distortion of the following medium in the input image that is generated by imaging the following medium or the jamming of the following medium.

By contrast, when the inter-media distance between the target medium and the following medium is less than the threshold determined for the target medium (NO in step S221), in step S223, the control unit 151 sets the ejection speed at which the ejection roller 124 ejects a medium to a second speed higher than the first speed. Then, the control unit 151 returns to step S201.

The second speed is set to, for example, the same speed as the reference speed. In other words, when the inter-media distance between the target medium and the following medium is less than the threshold determined for the target medium, the control unit 151 does not reduce the ejection speed at which the ejection roller 124 ejects the target medium. In this way, based on the skew of the target medium or the skew of the following medium, the control unit 151 changes the reference for determining whether to reduce the ejection speed at which the ejection roller 124 ejects the target medium. Thus, when the target medium and/or the following medium are skewed and the reduction in the ejection speed for ejecting the target medium is likely to cause contact between the target medium and the following medium, the media ejecting apparatus 100 does not reduce the ejection speed for ejecting the target medium. Accordingly, the media ejecting apparatus 100 can prevent the distortion of a medium in an input image or the jamming of media due to contact between continuously conveyed media while enhancing the alignment of ejected media.

Alternatively, the second speed may be set to a speed that is lower than the reference speed and higher than the first speed. In other words, when the inter-media distance between the target medium and the following medium is less than the threshold determined for the target medium, the control unit 151 reduces the degree of reduction in the ejection speed at which the ejection roller 124 ejects the target medium compared to when the inter-media distance is equal to or larger than the threshold. In this case, like the case described above, the media ejecting apparatus 100 can prevent the distortion of a medium in an input image or the jamming of media due to contact between the continuously conveyed media while enhancing the alignment of ejected media.

By contrast, when the deceleration timing has not been reached yet or has been already reached (NO in step S220), in step S224, the control unit 151 determines whether the ejection of the target medium has been completed. The control unit 151 determines that the ejection of the medium has been completed when a sixth given time has just elapsed after the trailing end of the medium passes the position of the ejection sensor 123. The sixth given time is set to the time taken for a medium to move from the position of the ejection sensor 123 to the output port. When the ejection of the target medium has not been completed yet (NO in step S224), the control unit 151 returns to step S201.

By contrast, when the ejection of the target medium has been completed (YES in step S224), in step S225, the control unit 151 returns the ejection speed at which the ejection roller 124 ejects a medium to the reference speed. Thus, the media processing on the target medium ends.

The control unit 151 may change the reference for determining whether to reduce the ejection speed by correcting the inter-media distance instead of changing the threshold to be compared with the inter-media distance. In other words, the control unit 151 may change the reference for determining whether to reduce the ejection speed by correcting the inter-media distance between the target medium and the preceding medium detected by the pick sensor 116 based on the skew of the target medium, the skew of the preceding medium, or the relationship between the skew of the target medium and the skew of the preceding medium. In this case, in step S207, the control unit 151 determines, based on the skew of the medium, a coefficient to be multiplied by the inter-media distance or an offset value to be subtracted from the inter-media distance and stores the determined coefficient or the determined offset value in the storage device 140. The control unit 151 sets the coefficient or the offset value such that the ejection speed at which the ejection roller 124 ejects a medium is more likely controlled so as not to be reduced as the skew of the medium is larger. In other words, the control unit 151 sets the coefficient to have a smaller value as the skew of the medium is larger, or the control unit 151 sets the offset value to have a larger value as the skew of the medium is larger. In step S221, the control unit 151 determines whether the inter-media distance between the target medium and the following medium, where the inter-media distance is corrected based on the coefficient or the offset value determined for the target medium, is equal to or larger than the threshold. The threshold in this case is preset to a fixed value. In this case, like the case described above, the media ejecting apparatus 100 can prevent the distortion of a medium in an input image or the jamming of media due to contact between the continuously conveyed media while enhancing the alignment of ejected media.

The control unit 151 may calculate the inter-media distance with the separation sensor 115, the first skew sensor 117, the second skew sensor 118, the feed sensor 121, or the ejection sensor 123, instead of the pick sensor 116. In this case, in step S202, the control unit 151 stores, as the second passing time, the time when the leading end of the target medium passes the position of the separation sensor 115, the first skew sensor 117, the second skew sensor 118, the feed sensor 121, or the ejection sensor 123 in the storage device 140. In step S217, the control unit 151 stores, as the first passing time, the time when the trailing end of the target medium passes through the position of the separation sensor 115, the first skew sensor 117, the second skew sensor 118, the feed sensor 121, or the ejection sensor 123 in the storage device 140. In step S206, the control unit 151 calculates, as the inter-media distance, the distance between the leading end of the target medium and the trailing end of the preceding medium in the media conveyance direction A2 at the position of the separation sensor 115, the first skew sensor 117, the second skew sensor 118, the feed sensor 121, or the ejection sensor 123. In this case, the separation sensor 115, the first skew sensor 117, the second skew sensor 118, the feed sensor 121, or the ejection sensor 123 is an example of a sensor that detects media.

When the size of the medium is determined, the control unit 151 may calculate the inter-media distance between the target medium and the preceding medium based on the distance between the leading ends of the target medium and the preceding medium, instead of the distance between the leading end of the target medium and the trailing end of the preceding medium. For example, the size of the medium is set by the user using the operation device 105 or an information processing device that is communicably connected to the media ejecting apparatus 100. In this case, the operations in steps S216 and S217 are omitted. In step S206, the control unit 151 calculates a multiplication value by multiplying a subtraction value, which is obtained by subtracting the second passing time of the preceding medium from the second passing time of the target medium, by the speed at which the feed roller 113 feeds media. The control unit 151 calculates the inter-media distance by subtracting the size of the medium in the media conveyance direction A2 from the calculated multiplication value. Calculation of the inter-media distance based on the distance between the leading ends of the target medium and the preceding medium eliminates the need for detection of the time at which the trailing end of the preceding medium passes the pick sensor 116. Thus, the media ejecting apparatus 100 reduces the processing load on the media processing. However, since the speed at which the medium moves may change during the conveyance of the medium, the media ejecting apparatus 100 calculates the inter-media distance based on the distance between the leading end of the target medium and the trailing end of the preceding medium to more accurately estimate the relationship between the trailing end of the preceding medium and the leading end of the target medium.

The detection unit 152 may detect the skew of the trailing end of the preceding medium as the skew of the preceding medium, instead of the skew of the leading end of the preceding medium. In this case, the detection unit 152 detects the skew of the medium based on the time when the trailing end of the medium passes each of the position of the first skew sensor 117 and the position of the second skew sensor 118. Since the skew of the medium may change during the conveyance of the medium, the media ejecting apparatus 100 uses the skew of the trailing end of the preceding medium as the skew of the preceding medium to more accurately estimate the relationship between the trailing end of the preceding medium and the leading end of the target medium. By contrast, the media ejecting apparatus 100 uses the skew of the leading end of each medium as the skew of each medium to reduce the processing load on the media processing without detecting the skew of the trailing end of each medium.

As described above in detail, the media ejecting apparatus 100 changes the reference for determining whether to reduce the ejection speed based on the skew of the target medium or the following medium while reducing the ejection speed for ejecting the target medium. Accordingly, the media ejecting apparatus 100 can prevent the distortion of a medium in an input image or the jamming of media due to contact between the continuously conveyed media while enhancing the alignment of ejected media. As a result, the media ejecting apparatus 100 can appropriately reduce the ejection speed for ejecting a medium.

When the inter-media distance between the continuously conveyed media is uniformly increased to prevent contact between the continuously conveyed media, the conveyance performance of the media decreases. The media ejecting apparatus 100 changes the reference for determining whether to reduce the ejection speed based on the skew of the medium to prevent the decrease in the conveyance performance of media, enhance the alignment of ejected media, and prevent the distortion of a medium in an input image or the jamming of media.

Figure 10:
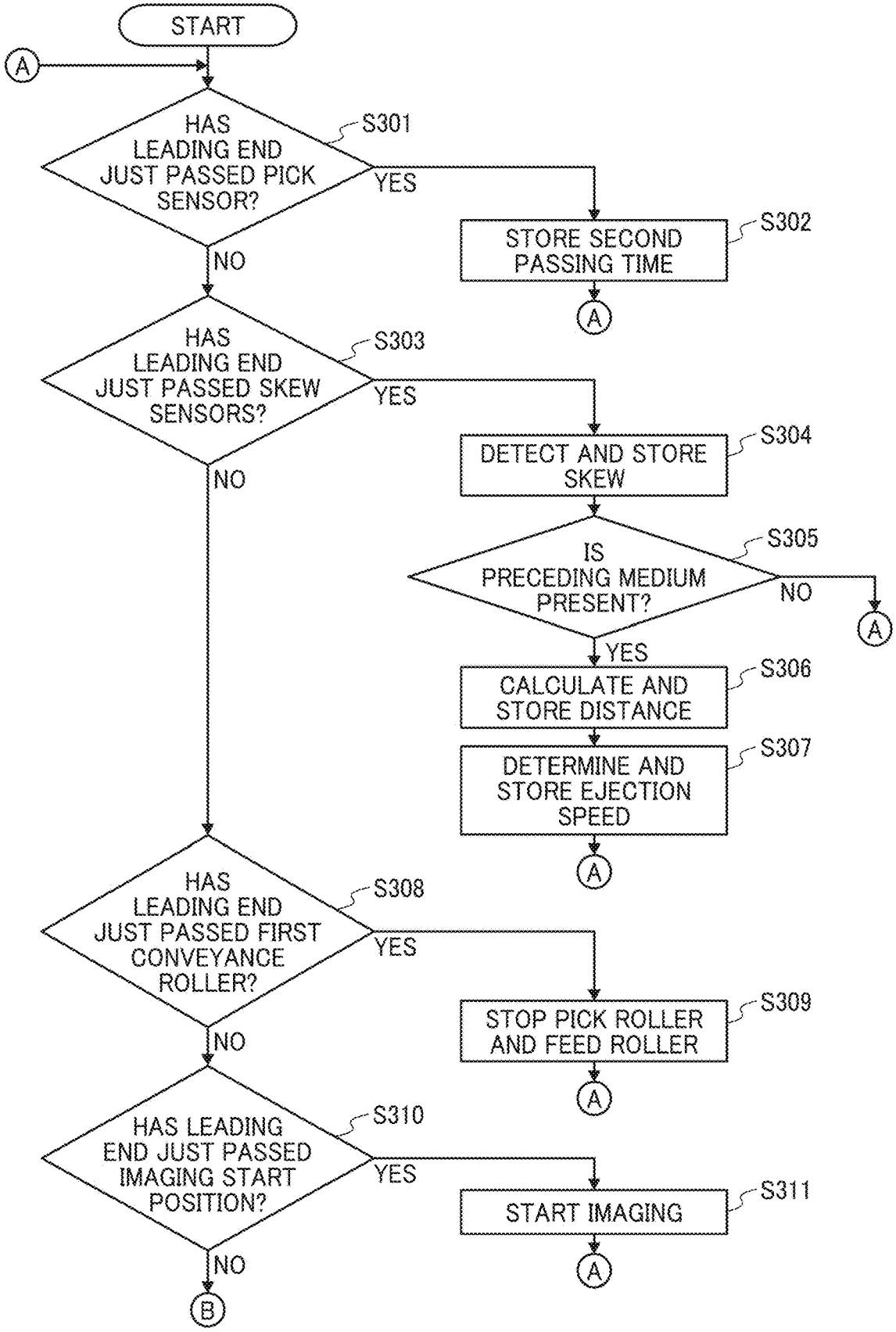
FIG. 10 is a flowchart illustrating an example of a part of other media processing.

FIG. 10 is a flowchart illustrating a part of media processing performed by a media ejecting apparatus according to another embodiment of the present disclosure.

The flowchart illustrated in FIG. 10 is executed instead of the flowchart illustrated in FIG. 7. Since the operations in steps S301 to S306 and S308 to S311 of FIG. 10 are respectively the same as the operations in steps S201 to S206 and S208 to S211 of FIG. 7, redundant descriptions thereof will be omitted. A description is given below of step S307 alone.

In step S307, the control unit 151 determines the ejection speed at which the ejection roller 124 ejects the preceding medium based on the skew of the medium detected by the detection unit 152 and stores the determined ejection speed in the storage device 140. As in the operation in step S207, the control unit 151 changes the ejection speed for ejecting the preceding medium based on the skew of the target medium, the skew of the preceding medium, or the relationship between the skew of the target medium and the skew of the preceding medium (the skew of one medium relative to the other medium). The control unit 151 sets the ejection speed for ejecting the preceding medium to be lower than the reference speed and to be higher as the skew of the medium is larger (in absolute value).

In the present embodiment, the operations in steps S221 and S223 of FIG. 8 are omitted. When the deceleration timing has just been reached for the first time (YES in step S220), in step S222, the control unit 151 sets the ejection speed at which the ejection roller 124 ejects a medium to the ejection speed determined in step S307. In this way, when the target medium and/or the following medium are skewed and the reduction in the ejection speed for ejecting the target medium is likely to cause contact between the target medium and the following medium, the media ejecting apparatus reduces the degree of reduction in the ejection speed for ejecting the target medium. As a result, the speed at which the target medium is ejected is not so reduced and the following medium is unlikely to contact the target medium. Accordingly, the media ejecting apparatus can prevent the decrease in the conveyance performance of media, enhance the alignment of ejected media, and prevent the distortion of a medium in an input image or the jamming of media.

As described above in detail, the media ejecting apparatus can appropriately reduce the ejection speed for ejecting a medium when changing the ejection speed at which the ejection roller 124 ejects a medium based on the skew of the target medium or the following medium while reducing the ejection speed for ejecting the target medium.

Figure 11:
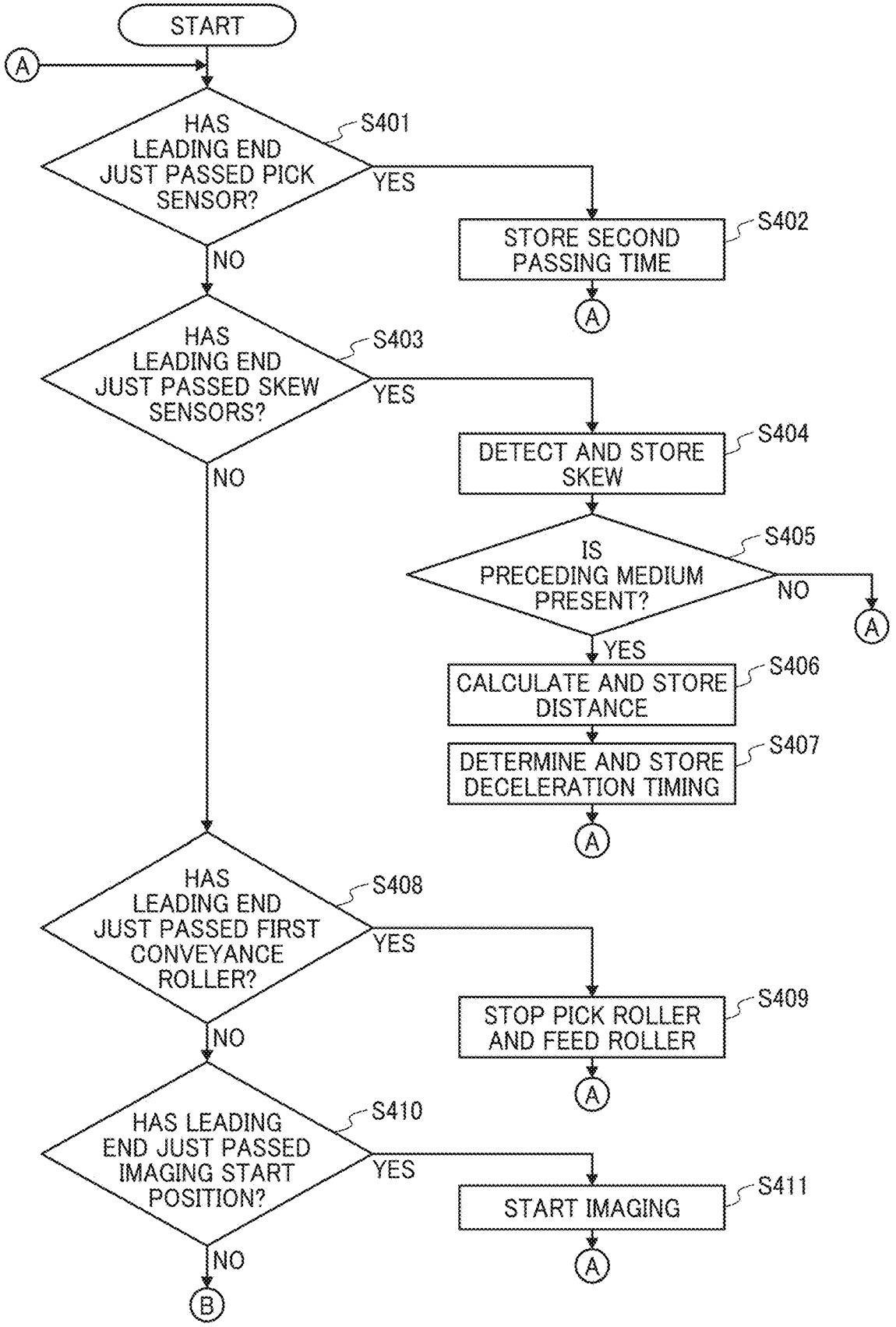
FIG. 11 is a flowchart illustrating an example of a part of yet other media processing.

FIG. 11 is a flowchart illustrating a part of media processing performed by a media ejecting apparatus according to yet another embodiment of the present disclosure.

The flowchart illustrated in FIG. 11 is executed instead of the flowchart illustrated in FIG. 7. Since the operations in steps S401 to S406 and S408 to S411 of FIG. 11 are respectively the same as the operations in steps S201 to S206 and S208 to S211 of FIG. 7, redundant descriptions thereof will be omitted. A description is given below of step S407 alone.

In step S407, the control unit 151 determines the timing to reduce the ejection speed at which the ejection roller 124 ejects the preceding medium (specifically, the timing to start reducing the ejection speed at which the ejection roller 124 ejects the preceding medium) based on the skew of the medium detected by the detection unit 152 and stores the determined time in the storage device 140. As in the operation in step S207, the control unit 151 changes the timing to reduce the ejection speed for ejecting the preceding medium, based on the skew of the target medium, the skew of the preceding medium, or the relationship between the skew of the target medium and the skew of the preceding medium (the skew of one medium relative to the other medium). The control unit 151 sets the timing to reduce the ejection speed for ejecting the preceding medium (specifically, the timing to start reducing the ejection speed for ejecting the preceding medium) to be later as the skew of the medium is larger. In other words, the control unit 151 sets the deceleration start position to be closer to the ejection roller 124 as the skew of the medium is larger.

In the present embodiment, in step S220 of FIG. 8, the control unit 151 determines whether the deceleration timing determined in step S407 has just been reached for the first time. The threshold that is compared with the inter-media distance between the target medium and the following medium in step S221 is set to a fixed value. In this way, when the target medium and/or the following medium are skewed and the reduction in the ejection speed for ejecting the target medium is likely to cause contact between the target medium and the following medium, the media ejecting apparatus delays the timing to reduce the ejection speed for ejecting the target medium. As a result, the time during which the target medium is conveyed at a low speed is shortened and the following medium is unlikely to contact the target medium. Accordingly, the media ejecting apparatus can prevent the decrease in the conveyance performance of media, enhance the alignment of ejected media, and prevent the distortion of a medium in an input image or the jamming of media.

As described above in detail, the media ejecting apparatus can appropriately reduce the ejection speed for ejecting a medium when changing, based on the skew of a medium, the timing to reduce the ejection speed at which the ejection roller 124 ejects a medium.

Figure 12:
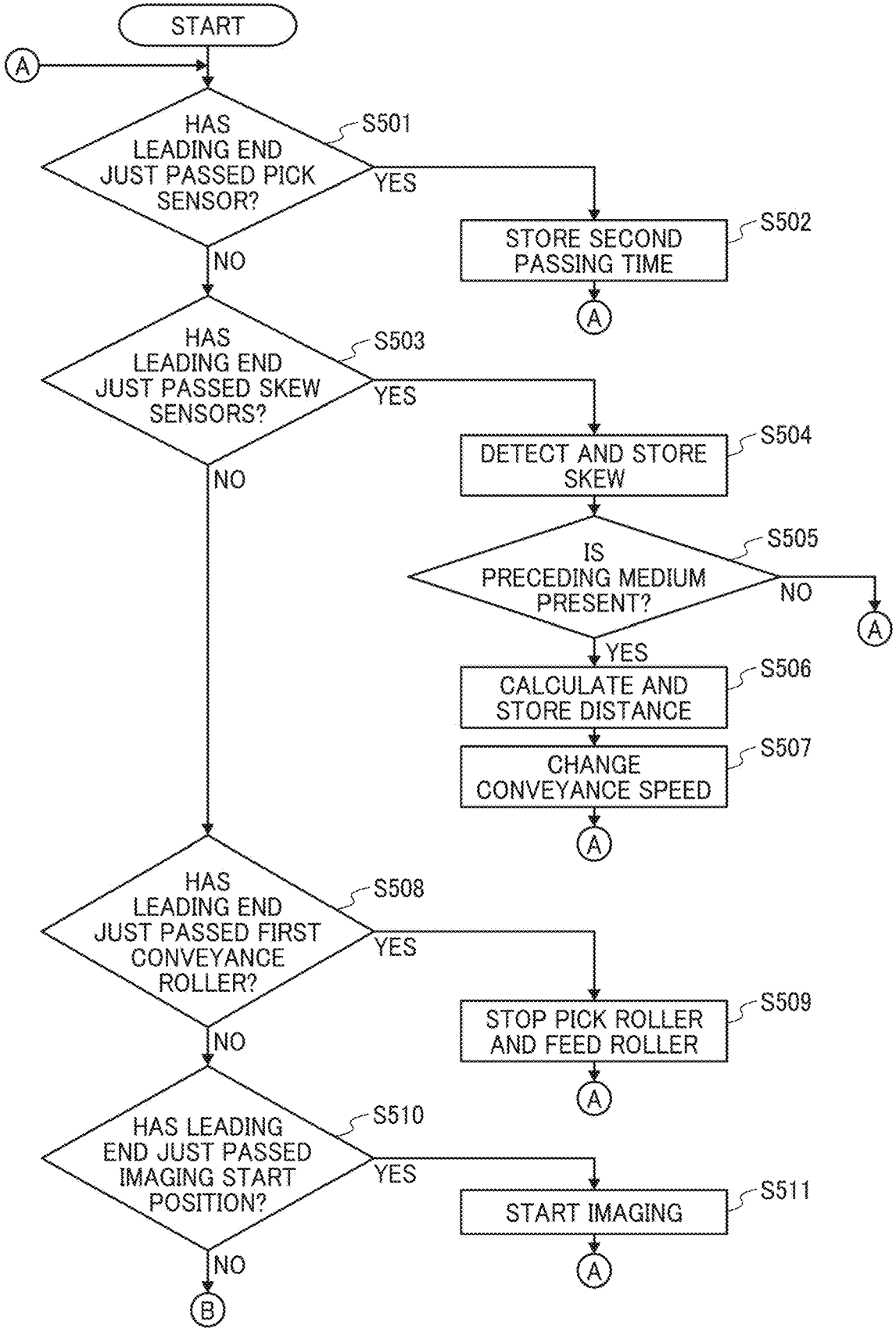
FIG. 12 is a flowchart illustrating an example of a part of yet other media processing.

FIG. 12 is a flowchart illustrating a part of media processing performed by a media ejecting apparatus according to yet another embodiment of the present disclosure.

The flowchart illustrated in FIG. 12 is executed instead of the flowchart illustrated in FIG. 7. Since the operations in steps S501 to S506 and S508 to S511 of FIG. 12 are respectively the same as the operations in steps S201 to S206 and S208 to S211 of FIG. 7, redundant descriptions thereof will be omitted. A description is given below of step S507 alone.

In step S507, the control unit 151 changes the conveyance speed at which the pick roller 112 and/or the feed rollers 113 convey the target medium, based on the skew of the medium detected by the detection unit 152. As in the operation in step S207, the control unit 151 changes the conveyance speed for conveying the target medium, based on the skew of the target medium, the skew of the preceding medium, or the relationship between the skew of the target medium and the skew of the preceding medium (the skew of one medium relative to the other medium). The control unit 151 sets the conveyance speed for conveying the target medium such that the inter-media distance between the preceding medium and the target medium increases as the skew of the medium increases. In other words, the control unit 151 sets the conveyance speed for conveying the target medium to be lower as the skew of the medium is larger. Thereafter, the target medium is conveyed at the speed set in step S507 until the leading end of the target medium passes the position of the first conveyance roller 119*a* in step S508 and the pick roller 112 and the feed roller 113 stop in step S509.

In the present embodiment, the threshold that is compared with the inter-media distance between the target medium and the following medium in step S221 of FIG. 8 is set to a fixed value. In this way, when the target medium and/or the following medium are skewed and the reduction in the ejection speed for ejecting the target medium is likely to cause contact between the target medium and the following medium, the media ejecting apparatus reduces the conveyance speed for conveying the following medium. Accordingly, the inter-media distance between the target medium and the following medium is secured and the following medium is unlikely to contact the target medium. Accordingly, the media ejecting apparatus can prevent the decrease in the conveyance performance of media, enhance the alignment of ejected media, and prevent the distortion of a medium in an input image or the jamming of media.

The control unit 151 may change the conveyance speed at which the first to fifth conveyance rollers 119*a* to 119*e* and/or the first to fifth driven rollers 120*a* to 120*e* convey the target medium based on the skew of the medium, instead of or in addition to the conveyance speed at which the pick roller 112 and/or the feed roller 113 convey the target medium. In this case, the control unit 151 monitors the positions of the preceding medium and the target medium and changes (reduces) the conveyance speed of the rollers that sandwich the target medium among the pick roller 112, the feed roller 113, the first to fifth conveyance rollers 119*a* to 119*e*, and the first to fifth driven rollers 120*a* to 120*e*. In this case, the pick roller 112, the feed roller 113, the first to fifth conveyance rollers 119*a* to 119*e*, and/or the first to fifth driven rollers 120*a* to 120*e* are examples of the conveyance rollers that convey media.

The control unit 151 may increase the inter-media distance between the target medium and the preceding medium by stopping the pick roller 112 and/or the feed roller 113 for a given time to stop the conveyance (feeding) of the target medium. In this case, in step S507, the control unit 151 changes the time during which the pick roller 112 and/or the feed roller 113 stop conveying the target medium, based on the skew of the target medium, the skew of the preceding medium, or the relationship between the skew of the target medium and the skew of the preceding medium. The control unit 151 sets the time during which the conveyance of the target medium is stopped to be longer as the skew of the medium is larger. In this case, the media ejecting apparatus can prevent the decrease in the conveyance performance of media, enhance the alignment of ejected media, and prevent the distortion of a medium in an input image or the jamming of media.

The control unit 151 may stop the target medium by stopping the rollers that sandwich the target medium among the pick roller 112, the feed roller 113, the first to fifth conveyance rollers 119*a* to 119*e*, and the first to fifth driven rollers 120*a* to 120*e* for the set time. In this case, the pick roller 112, the feed roller 113, the first to fifth conveyance rollers 119*a* to 119*e*, and/or the first to fifth driven rollers 120*a* to 120*e* are examples of the conveyance rollers that convey media.

As described above in detail, the media ejecting apparatus can appropriately reduce the ejection speed for ejecting a medium when changing, based on the skew of a medium, the conveyance speed at which the conveyance rollers convey the following medium or the time during which the conveyance rollers stop conveying the following medium.

Figure 13:
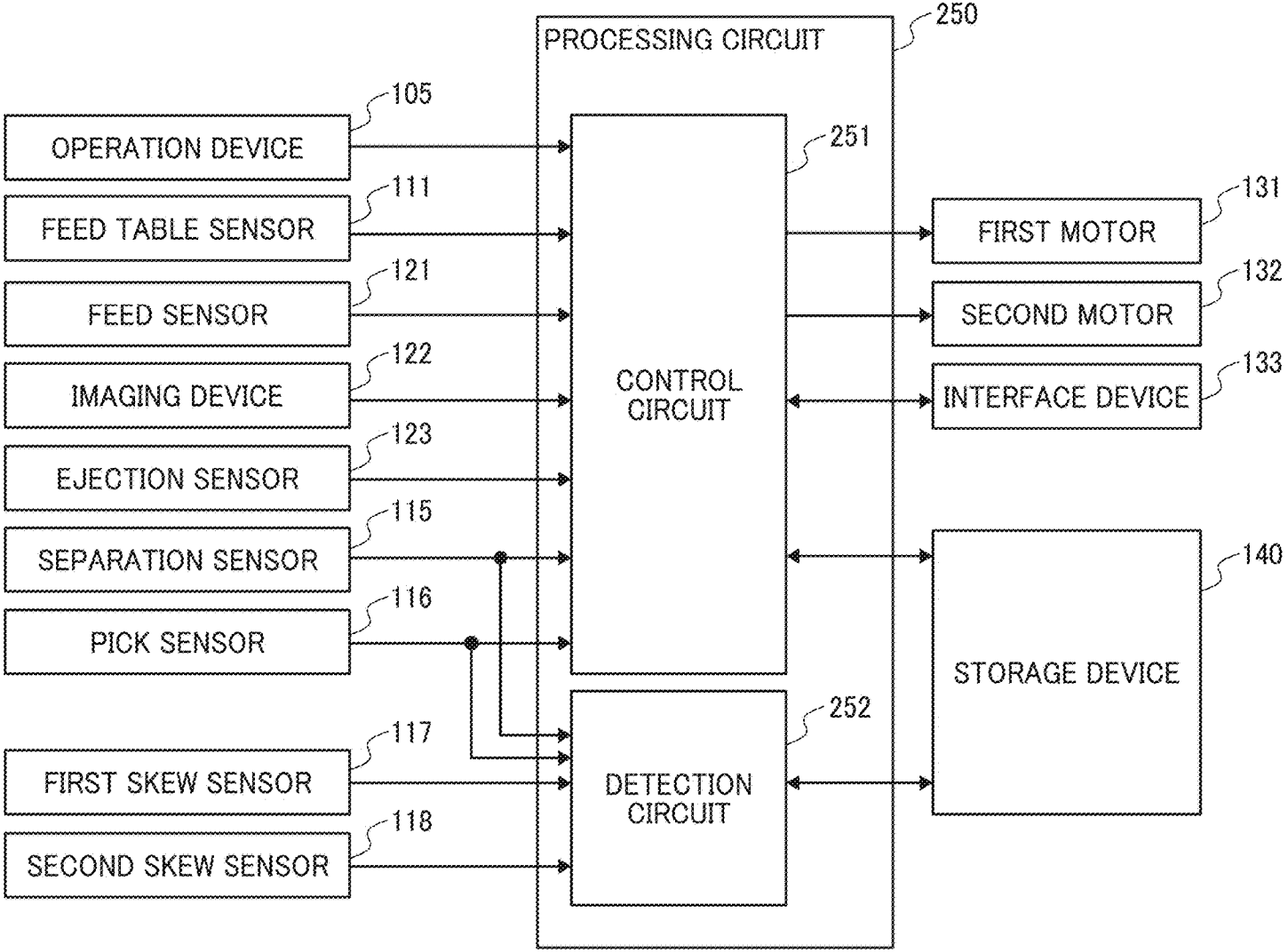
FIG. 13 is a schematic diagram illustrating a configuration of a processing circuit according to another embodiment of the present disclosure.

FIG. 13 is a schematic diagram illustrating a configuration of a processing circuit 250 of a media ejecting apparatus according to another embodiment of the present disclosure.

The processing circuit 250 is used instead of the processing circuit 150 of the media ejecting apparatus 100. The processing circuit 250 executes, for example, the overall processing and the media processing, instead of the processing circuit 150. The processing circuit 250 includes, for example, a control circuit 251 and a detection circuit 252. These circuits may be, for example, independent integrated circuits, microprocessors, or firmware.

The control circuit 251 is an example of a control unit and functions like the control unit 151. The control circuit 251 receives the operation signals from the operation device 105 or the interface device 133. The control circuit 251 also receives the feed table signals, the separation signals, the pick signals, the feed signals, and the ejection signals from the feed table sensor 111, the separation sensor 115, the pick sensor 116, the feed sensor 121, and the ejection sensor 123, respectively. The control circuit 251 reads the skew of a medium from the storage device 140. The control circuit 251 controls the first motor 131 and the second motor 132 based on the received signals and/or the read information, acquires an input image from the imaging device 122, and outputs the input image to the interface device 133.

The detection circuit 252 is an example of a detection unit and functions like the detection unit 152. The detection circuit 252 receives the separation signals, the pick signals, the first skew signals, and the second skew signals from the separation sensor 115, the pick sensor 116, the first skew sensor 117, and the second skew sensor 118, respectively. The detection circuit 252 detects the skew of a medium based on the received signals and stores the detected skew in the storage device 140.

As described above in detail, the media ejecting apparatus including the processing circuit 250 can appropriately reduce the ejection speed for ejecting a medium.

Although several embodiments of the present disclosure have been described above, the embodiments are not limited thereto. For example, the media ejecting apparatus may change, based on the skew of a medium, any two or more parameters among the reference for determining whether to reduce the ejection speed, the ejection speed, the timing to reduce the ejection speed, the conveyance speed at which the conveyance rollers convey media, and the time during which the conveyance rollers stop conveying media. Accordingly, the media ejecting apparatus can control the ejection of media with increased flexibility.

The media ejecting apparatus may include a so-called straight path to feed and convey the media from bottom to top from the feed table. In this case, the feed roller is disposed below the separation roller to face the separation roller.

A description is given below of several aspects of the above embodiments of the present disclosure.

According to a first aspect, a media ejecting apparatus includes a conveyance roller, a detection unit, an ejection roller, and a control unit. The conveyance roller conveys a medium. The detection unit detects the skew of the medium conveyed by the conveyance roller. The ejection roller ejects the medium conveyed by the conveyance roller. The control unit reduces an ejection speed at which the ejection roller ejects a first medium when the ejection roller ejects the first medium. The control unit changes the ejection speed based on the relationship between the first skew of the first medium and the skew of a second medium following the first medium.

A media ejecting apparatus, a media ejection method, and a control program according to one or more aspects of the present disclosure can appropriately reduce the ejection speed for ejecting a medium.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), field programmable gate arrays (FPGAs), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of a FPGA or ASIC.

The invention claimed is:

1. A media ejecting apparatus, comprising:

a conveyance roller to convey a first medium and a second medium following the first medium;

an ejection roller to eject the first medium and the second medium; and circuitry configured to reduce a first ejection speed at which the ejection roller ejects the first medium, wherein the circuitry is configured to:

determine a second skew of the second medium; and change whether to reduce the first ejection speed, based on the second skew.

2. The media ejecting apparatus according to claim 1, further comprising a sensor to detect the first medium and the second medium, wherein, the circuitry is configured to:

reduce the first ejection speed in a case where a distance between the first medium and the second medium detected by the sensor is equal to or larger than a threshold when the ejection roller ejects the first medium; and change whether to reduce the first ejection speed by changing the threshold or correcting the distance based on the second skew.

3. The media ejecting apparatus according to claim 1, wherein the circuitry is configured to determine a first skew of the first medium, and change whether to reduce the first ejection speed, based on a relationship between the first skew and the second skew.

4. The media ejecting apparatus according to claim 1, further comprising:

a conveyance motor to drive the conveyance roller; and an ejection motor to drive the ejection roller, wherein the conveyance motor and the ejection motor are separate from each other.

5. A media ejecting method, comprising:

conveying a first medium and a second medium following the first medium with a conveyance roller;

ejecting the first medium and the second medium with an ejection roller; and reducing a first ejection speed at which the ejection roller ejects the first medium, wherein the reducing includes determining a second skew of the second medium, and changing a reference for determining whether to reduce the first ejection speed, based on the second skew.

6. A non-transitory recording medium storing a plurality of instructions which, when executed by one or more processors on a media ejecting apparatus, causes the one or more processors to perform a media ejecting method, the media ejecting apparatus including a conveyance roller to convey a first medium and a second medium following the first medium and an ejection roller to eject the first medium and the second medium, the method comprising reducing a first ejection speed at which the ejection roller ejects the first medium, wherein the reducing includes determining a second skew of the second medium, and changing whether to reduce the first ejection speed, based on the second skew.

* * * * *